United States Patent [19]

Saunders

[11] Patent Number: 4,537,131

[45] Date of Patent: Aug. 27, 1985

[54] APPARATUS FOR INITIATING EXPLOSIONS AND METHOD THEREFOR

[75] Inventor: Peter J. Saunders, Dundonald, Scotland

[73] Assignee: Imperial Chemical Industries PLC, London, England

[21] Appl. No.: 497,222

[22] Filed: May 23, 1983

[30] Foreign Application Priority Data

Jun. 3, 1982 [GB] United Kingdom ..... 8216211

[51] Int. Cl.[3] ..... F42C 11/06

[52] U.S. Cl. ..... 102/217; 102/200

[58] Field of Search ..... 102/200, 217

[56] References Cited

U.S. PATENT DOCUMENTS

| | | | |
|---|---|---|---|
| 3,934,514 | 1/1976 | Dawkins | 102/217 |
| 4,157,069 | 6/1979 | Gustafsson et al. | 102/200 |
| 4,324,182 | 4/1982 | Kirby et al. | 102/217 |

FOREIGN PATENT DOCUMENTS

| | | | |
|---|---|---|---|
| 2920485 | 11/1979 | Fed. Rep. of Germany | 102/200 |

*Primary Examiner*—Charles T. Jordan

*Attorney, Agent, or Firm*—Cushman, Darby & Cushman

[57] ABSTRACT

Detonating apparatus comprises a plurality of multi-channel exploders (MCEs) connected to a control unit which provides an operator/apparatus interface remote from the MCE's detonator circuits. MCEs measure integrity, resonant frequency and impedance at resonance of the detonator circuits connected to each channel, and are thereby programmed to give optimum firing current at the resonant frequency. The control unit provides electrical power, interrogates the MCEs on the status of their detonator circuits, and gives firing signals to be obeyed by MCEs after predetermined delays.

17 Claims, 25 Drawing Figures

Figure 1:
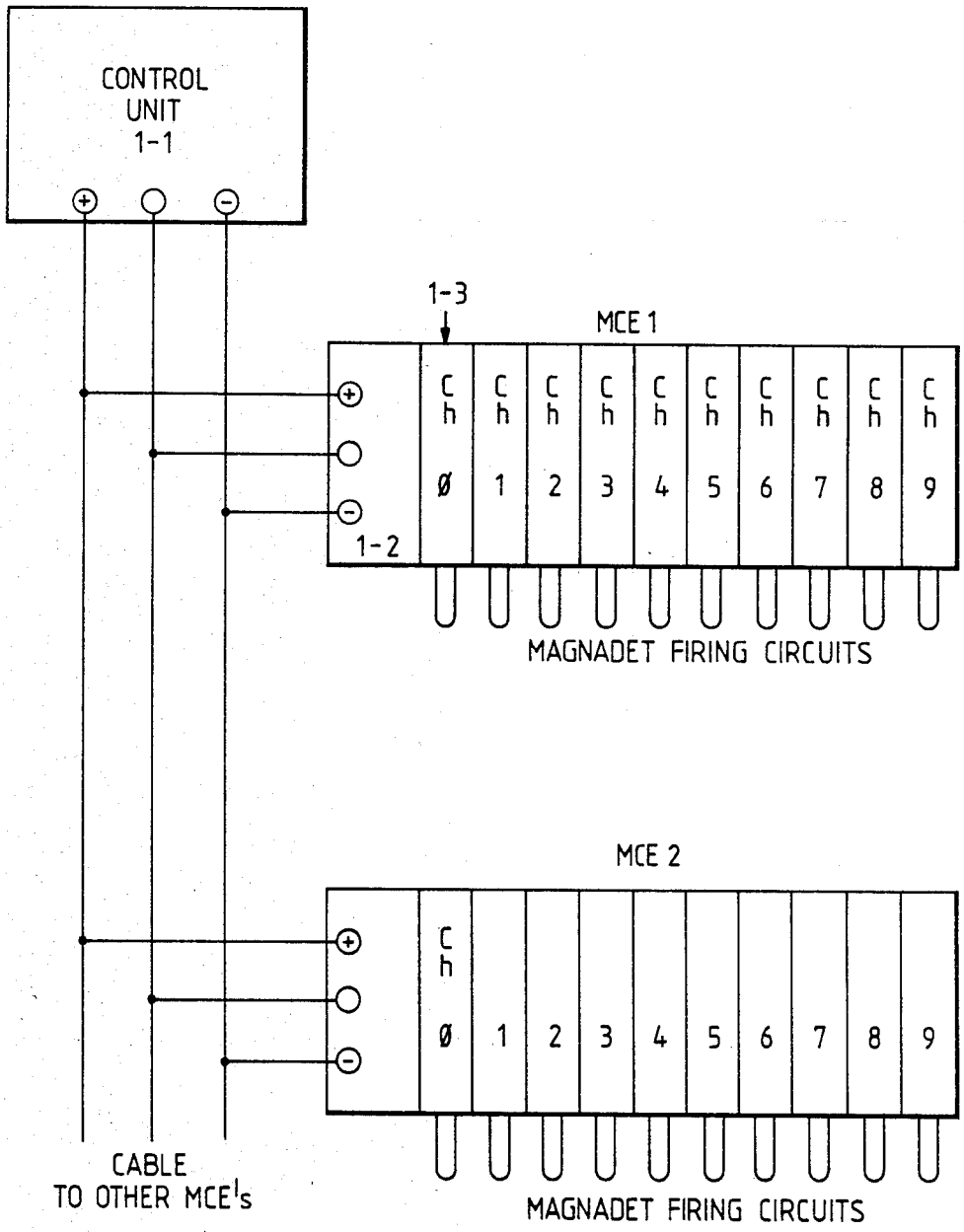

LOAD CONTROL H
LOAD FREQ H
LOAD DELAY LOW L
LOAD DELAY HIGH L
ADL 1
ADL 2
READ OUT H
74C08
CD4093
19-3
19-4
CDP1859
19-5
2:4LINE DECODER
AD1
AD0
AD1
AD0
SEL H
74C74
19-2
FLIP-FLOP
0
D
C
1
4-BIT COMPARATOR
74C85
19-1
AD5
AD4
AD3
AD2
RD
WR
SEL 3
SEL 2
SEL 1
SEL 0
LA
FIRE ENABLE 1(1) H
DET H
V SEL 1 H
V SEL 0 H
+5V
POWER H
19-7
QUAD D-TYPE FLIP-FLOP
AD3
AD2
AD1
AD0
AADD0
AADD1
TEST ON H
FIRE ENABLE 2 (1) H
19-6
QUAD D-TYPE FLIP-FLOP
AD7
AD6
AD5
AD4
LOAD CONTROL H

APPARATUS FOR INITIATING EXPLOSIONS AND METHOD THEREFOR

The invention relates to electrical apparatus for initiating explosions by providing an electrical firing current in a plurality of detonator circuits.

Many large scale blasting applications, such as quarrying and shaft drilling, require sequence blasting in which explosive charges or groups of explosive charges are detonated at different times, often separated by quite small time intervals. This provides a variety of advantages such as minimisation of noise and vibration and for enabling a substantial depth of blasting to be achieved in a single sequence while maintaining a free face for each explosion. Sequence blasting is generally achieved using multichannel exploders (MCEs), each channel being connected to a detonator circuit linking a number of detonators (typically 200) so that an electrical firing current supplied to the detonator circuit will fire the detonators, the size and nature (e.g. AC or DC) of the current required being determined by the detonators. To obtain the desired sequence of explosions, once a firing sequence has been initiated, different explosive charges may be detonated at different times using pyrotechnic or electrical delay devices in the individual detonators, or preferably by using electrical delay means in the MCE to provide a firing current in its different channels at different times. Both forms can be used in combination.

We have now identified a number of (often dangerous) deficiences in conventional systems and have devised an apparatus which overcomes many of them, especially in its preferred form. Thus for example, we find that in practice it is all too common for only a proportion of the charges to become exploded, leaving unexploded charges in the rubble and debris formed in the explosion; or even more dangerously, a blasting face may be only partly severed from a cliff or cutting face, leaving an unstable rock structure containing primed but unexploded charges, poised to collapse unpredictably when disturbed.

These failures seem to occur most frequently through breaks in the detonator circuits occuring in one or more channels. These circuits could each be tested as they are connected up, but in view of the necessary proximity of the MCEs to the blasting face in order to keep the detonator circuits short, such testing is not without its own obvious hazards. Moreover it is not unknown for such breaks to occur after such testing has been completed, e.g. when disturbed by a retreating operator.

According to the present invention an apparatus for initiating explosions by providing an electrical firing current in a plurality of detonator circuits connected thereto comprises a control unit locatable remote from the detonator circuits, at least one multi-channel exploder (MCE) connected to said control unit and having a plurality of channels, each channel provided with output means for connection to one of the detonator circuits; each MCE comprising energy storage means for receiving and storing electrical energy provided by the control unit, means for testing the impedance of the detonator circuit connected to each channel thereby to detect whether the circuit is complete or broken, and firing means responsive to a firing signal from the control unit for converting at least a portion of the energy stored in the storage means into a firing current in each channel at a predetermined time interval after receipt of the firing signal; and the control unit comprising an energy source from which to provide the electrical energy requirements of all the MCEs connected thereto, means for interrogating each MCE to determine whether or not all of the MCE's channels have complete detonator circuits, and a firing signal generator to activate the firing means in the MCEs.

In some applications, a substantial number of MCEs are required. In such cases we prefer to provide the control unit and each of the MCEs, with send and receive circuits including addressing means to enable each MCE to be interrogated by the control unit, e.g. to determine the state of the detonator circuits, using a common communications link. In this manner the expensive provision of separate communications links (e.g. electrical wires or fibre optics) for each MCE, over what may suitably be a substantial distance to the control unit, is avoided.

In applications where a substantial number of MCE's are required, the problem arises of ensuring that all the MCE's will respond to the firing signal from the control unit. In our preferred apparatus the control unit has a firing signal generator adapted to transmit at least one characteristic frequency and the interrogating means is adapted to determine whether or not all of the MCE's are detecting the presence of the characteristic frequency, and each MCE contains a means for detecting the presence of the characteristic frequency and a means for communicating the presence of the characteristic frequency to the control unit.

Our preferred MCEs comprise a processor and a plurality of channels connected to and controlled by the processor, the latter also providing an interface between the channels and the communications link to the control unit, the channels each having their own energy storage means, impedance testing means and firing means. We also prefer that each firing means has its own built-in time delay means (rather than use one common to all channels of that MCE), so that when the fire signal decoder emits a fire signal in response to a signal from the control unit, each channel individually counts its own delay time.

When using a DC detonator current we prefer to test the impedance of the detonator circuit, by applying a DC voltage which is less than that which is required to produce a current just sufficiently large to fire the detonators, the impedance measured by such tests being the DC resistance. Similarly, when testing prior to providing an AC detonating current, we prefer to measure the impedance to an alternating current by applying an alternating test voltage. In either case a nominal impedance indicates a complete circuit whereas an infinitely high impedance indicates a broken circuit.

For any detonator there is an optimum size of current, which can be predetermined (e.g. by the manufacturers), in that a smaller current may not fire such detonators consistantly and a larger current is wasteful in carrying and dissipating an excess of energy. Likewise, for each detonator circuit, the optimum voltage to be applied to the circuit by the exploder channel, is that which produces the optimum firing current in all its detonators. This can be determined by measuring the impedance of the circuit, e.g. during testing for circuit completeness. A preferred apparatus is thus one wherein each impedance testing means is adapted to provide a quantitative measurement of the impedance of the circuit tested, and each channel comprises means responsive to its measured impedance for regulating the voltage of the energy stored, or the proportion thereof converted to a firing current, to that voltage which produces a predetermined optimum current in its detonator circuit.

We find that DC-fired detonators, arranged in series around the detonator circuit in known manner, suffer various drawbacks, such as sensitivity of the circuit to outside interference signals, shorting and complete circuit failure due to failure of a single detonator. We prefer to use transformer coupled detonators of a kind which can be fired using alternating current (AC) induced in a bridge wire connected to a secondary coil wound round a transformer core, as we find then that many of the drawbacks associated with DC-fired detonators can be mitigated or even avoided altogether. We particularly prefer to use toroid coupled detonators such as those developed by Imperial Chemical Industries PLC, and marketed under the name "Magnadet".

Toroid coupled detonators such as that described above are used together with ferrite rings. Each detonator has its own associated ring, with the leading wire from each detonator being threaded several times (typically 4 turns) about its associated ring, to form a secondary circuit. The length of the leading wires is such as to ensure that the rings are situated at the mouth of each blast hole and energy is fed from an exploder to the system via a primary wire which is threaded once only through each ring.

With such a system described above, an attractive feature is the frequency selective characteristics of the ferrite rings. Thus, the rings have a band-pass characteristic which effectively attentuates low frequency signals having a frequency below about 10 kHz and high frequency signals having a frequency above about 100 kHz. Thus, as the leading wire of each detonator constitutes an isolated closed loop the detonators are substantially immune to stray currents and earth leakage.

A problem with such systems is that at frequencies of 15–25 kHz (which is the frequency range in which the best energy transfer is obtained via the ferrite rings) there is a considerable loss of firing current due to the inductance of the system. This will vary, mainly in accordance with the number of ferrite rings and associated detonator units used, and with the configuration of the detonator circuit providing the primary wire; the total impedance being a minimum at the resonant frequency of the detonator circuit. It is therefore desirable that the detonator circuit duly coupled to the detonators, has a resonant frequency within the range 15–25 kHz, and also that the resonant frequency of the circuit be substantially equal to the frequency of the AC detonating current used, increasing divergence from this desideratum leading to increased loss of firing current.

It is possible to tune each circuit to a fixed frequency by inserting a series capacitor of a value which will result in series resonance at the fixed frequency. However, it would then be necessary to measure the inductance of each circuit in situ, compute the capacitance required, select a suitable capacitor from a stock thereof, and then insert the capacitor in circuit with the system. This procedure is time consuming, dangerous, and requires a stock of capacitors and skilled personnel.

Fortunately, we have found we can tackle the problem in a different manner. The frequency range of 15–25 kHz is sufficiently broad that the outputs of the MCE channels can readily be adapted (e.g. with a series capacitor) so that all the detonator circuits will have a resonant frequency somewhere within that range, despite variations in the number of coupled detonators. This adaptation can be predetermined under safe conditions. We combine this with the use of an AC firing current whose frequency is adjusted to equal the resonant frequency of the particular detonator circuit being considered, for, as will be realised, it is possible for all the detonator circuits connected to a single MCE to be different. However, before describing the apparatus we have developed for achieving these results, it should be mentioned that the voltage required to provide the optimum firing current, referred to above, will depend on the closeness or otherwise of the firing current frequency to the resonant frequency of the detonator circuit.

With these aims in mind, in our preferred apparatus, the means for testing the impedance of the detonator circuit comprises a variable frequency generator for applying an alternating test signal to the detonator circuit at a current which is less than that required to fire its detonators and at a frequency which at least includes the resonant frequency of the detonator circuit, and impedance detecting means adapted to detect the impedance at the resonant frequency, the firing means comprising variable frequency means for producing a firing current substantially at the resonant frequency of the detonator circuit. In this, the testing means and the firing means preferably utilise the same frequency generator, although associated circuitry will be different at least in so far as the testing current must be very much less than the firing current.

There may also be other differences in that the test signal may be of changing frequency while the firing current frequency is locked to the resonant frequency. Thus in a particularly preferred apparatus, the variable frequency generator of the testing means is adapted to provide a test signal scanning a predetermined range of frequencies (most suitably 15–25 kHz), the testing means also comprising means to monitor changes in the detonator circuit impedance with changes in the test signal frequency and thereby to detect any frequency at which the impedance passes through a minimum, means to measure this minimum impedance and the frequency at which it occurs, this latter being the resonant frequency, and means to indicate when the measured impedance fails to pass through a minimum within the range of frequencies applied; and the firing means having programmable means for locking the frequency of the firing current to the resonant frequency of the detonator circuit as determined by the testing means.

An alternative approach is to detect and lock both test and firing currents to the resonant frequency of the circuit, automatically. This can be achieved in an apparatus wherein the testing means comprises feed back from the detonator circuit and wherein the frequency generator is responsive to the feed back to lock the frequency of the test signal to the resonant frequency of the loop. The firing means can then either be programmed to lock to the same frequency, or can be dynamic in operation and respond to feed back in a manner similar to that used for the test signal. Single channel exploders which can be effectively used in the context, one in each channel of each MCE, are those devised and developed by Geller, Wilson and Plichta, and described in British patent application No. 81 19236 (now published specification No. 2,096,415A), for example.

Despite all the above precautions, it is possible that any one channel could fail to explode, sometimes without this being obvious to the operator. An additional safeguard which can readily be added is the provision in each MCE channel of means for detecting when it fails to supply a firing current in response to a firing signal, and a control unit having means for indicating when any channel has so failed We further prefer each MCE to have means for identifying any failed channel, and the control unit to have means for displaying such identification.

Figure 2:
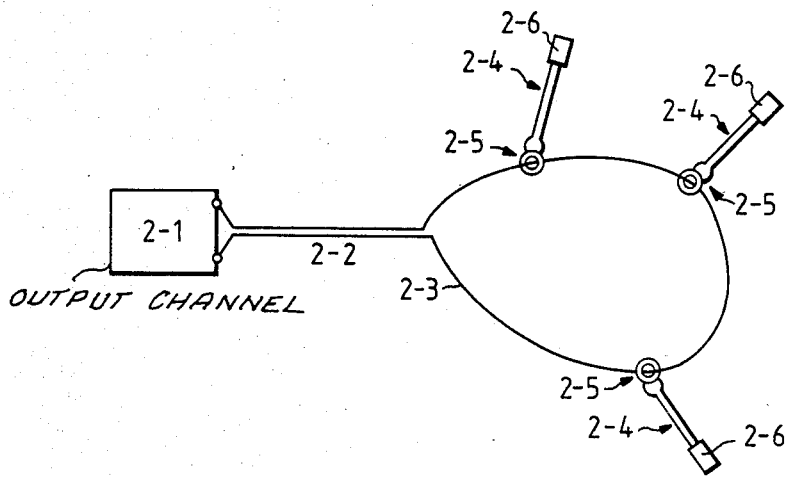
Figure 3:
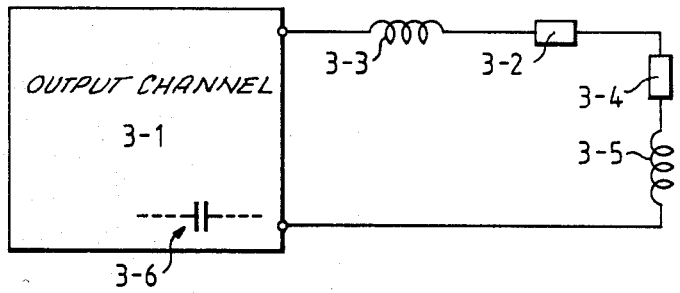
Figure 4:
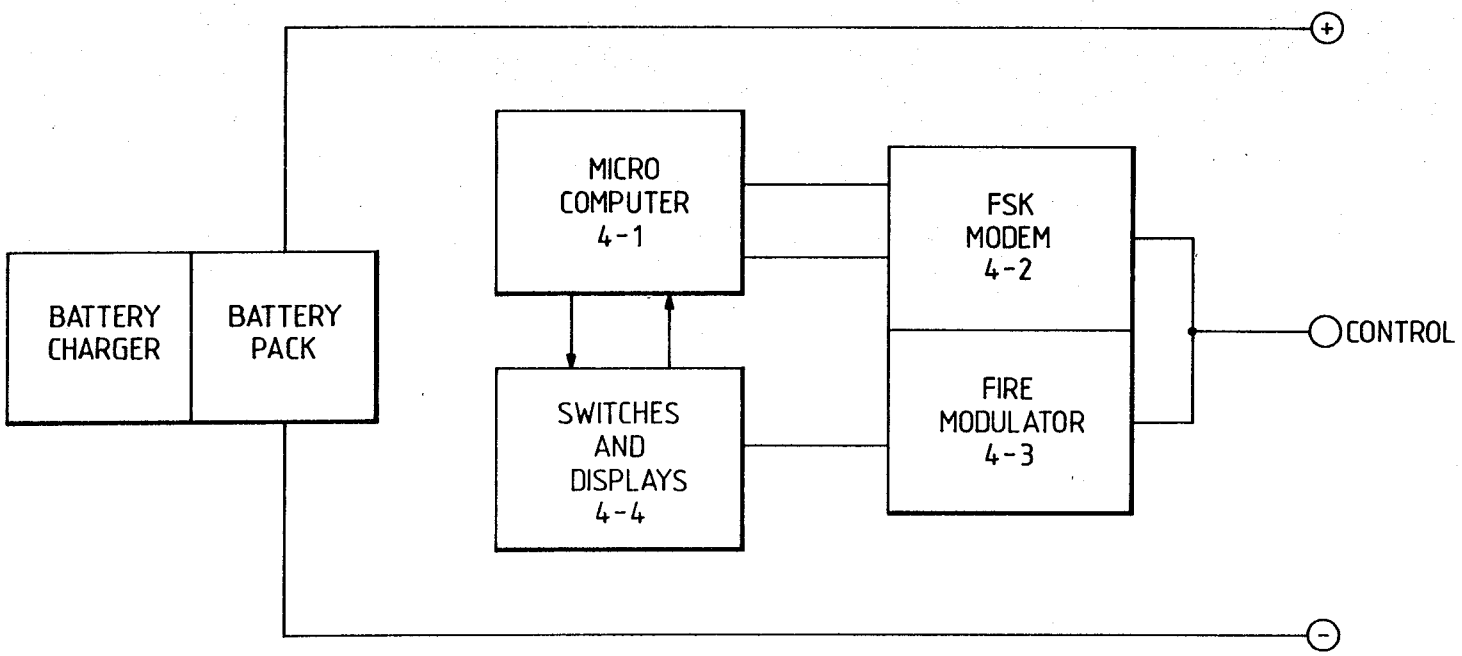
Figure 7:
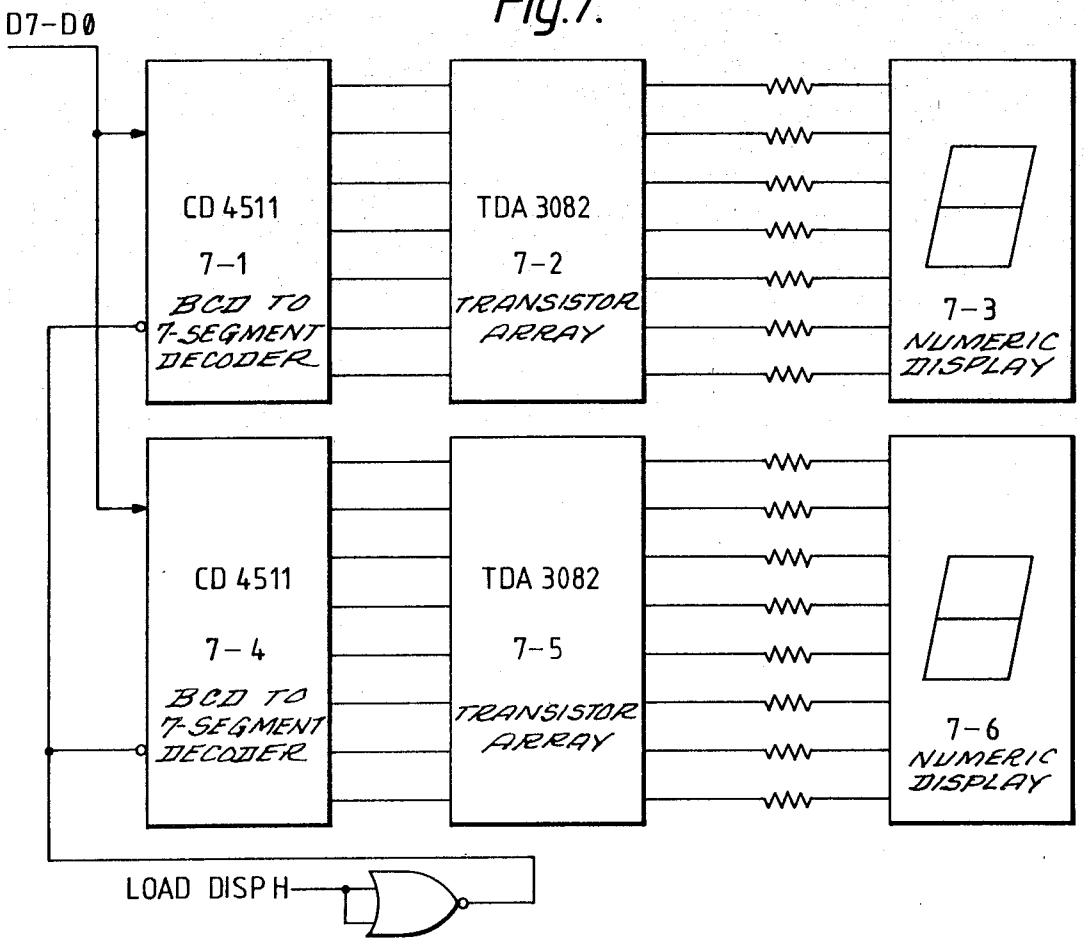
Figure 8:
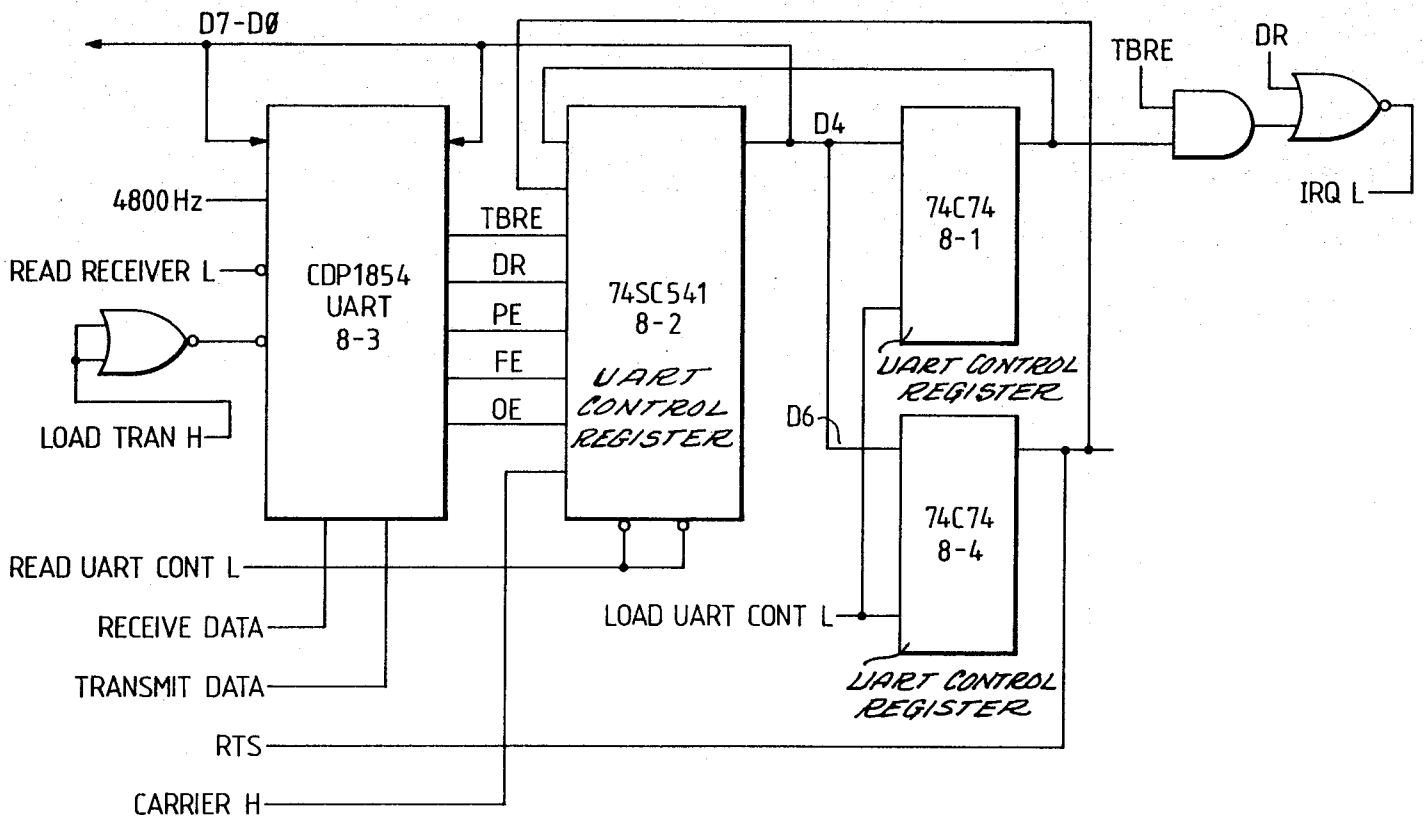
Figure 9:
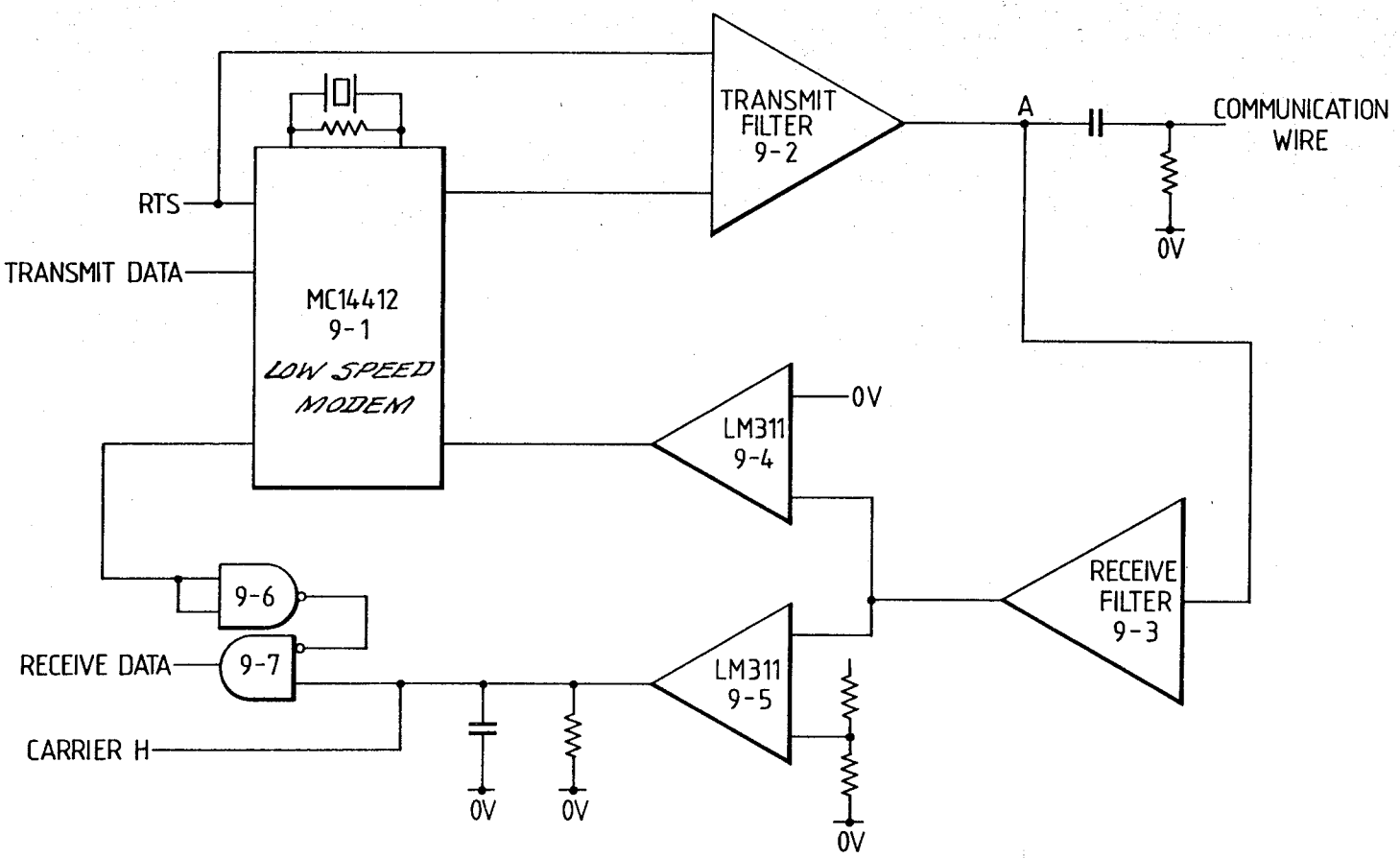
Figure 10:
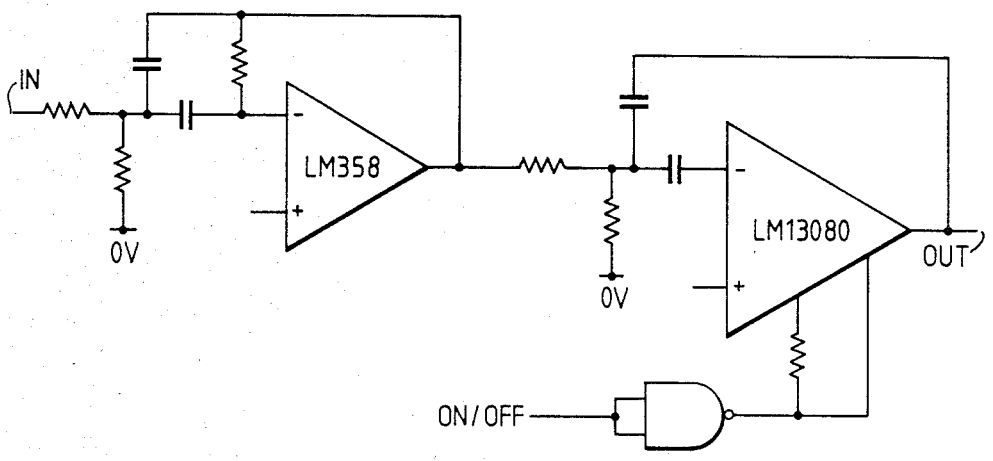
Figure 11:
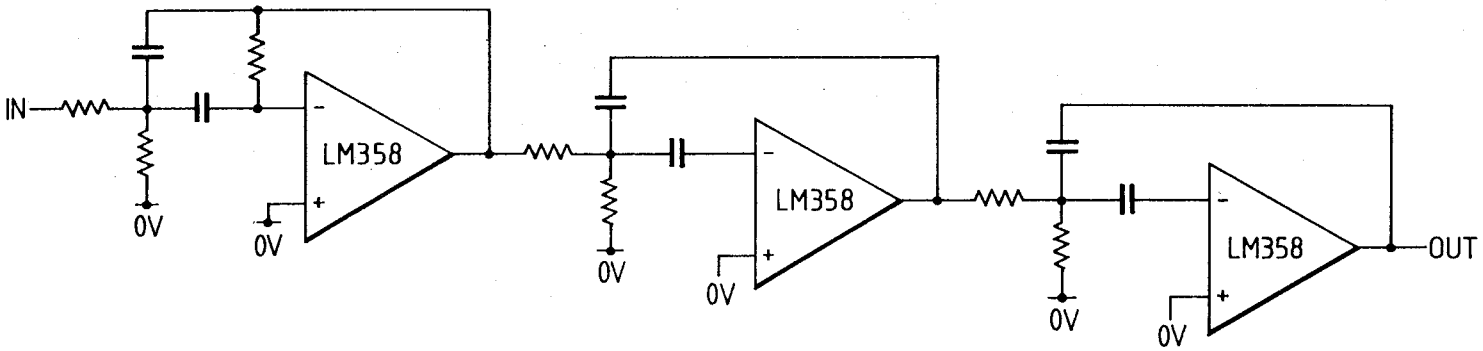
Figure 12:
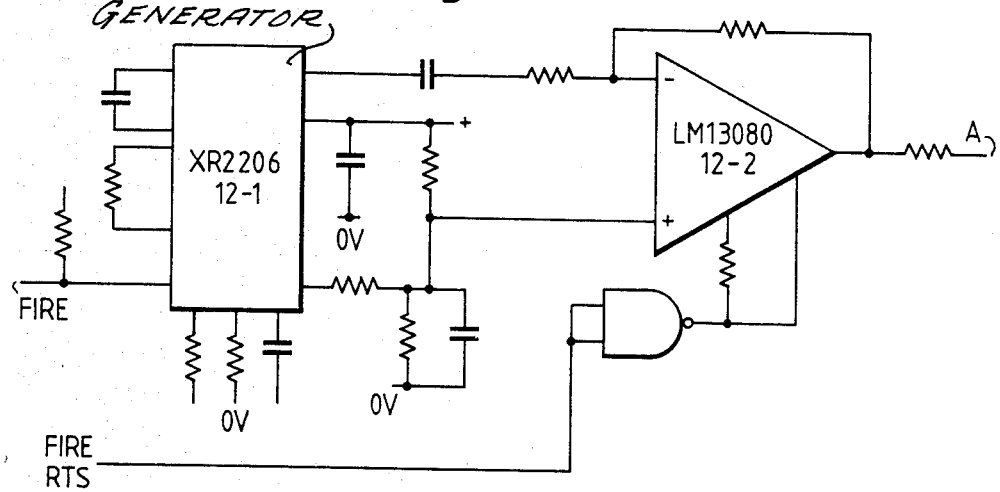
Figure 13:
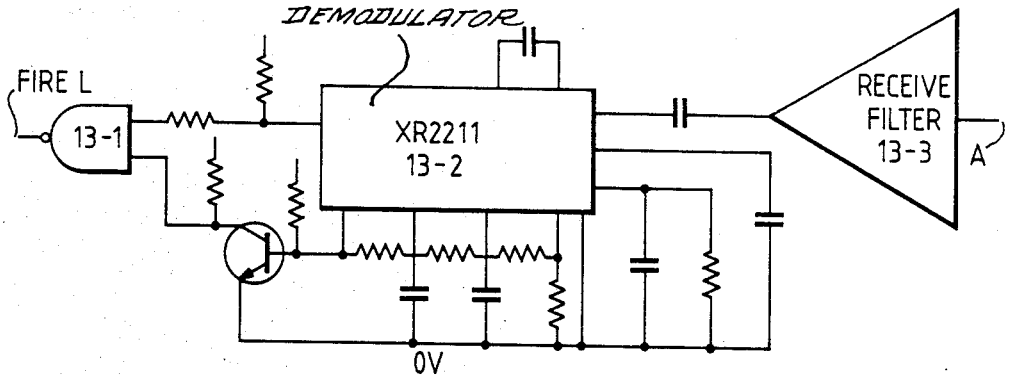
Figure 14:
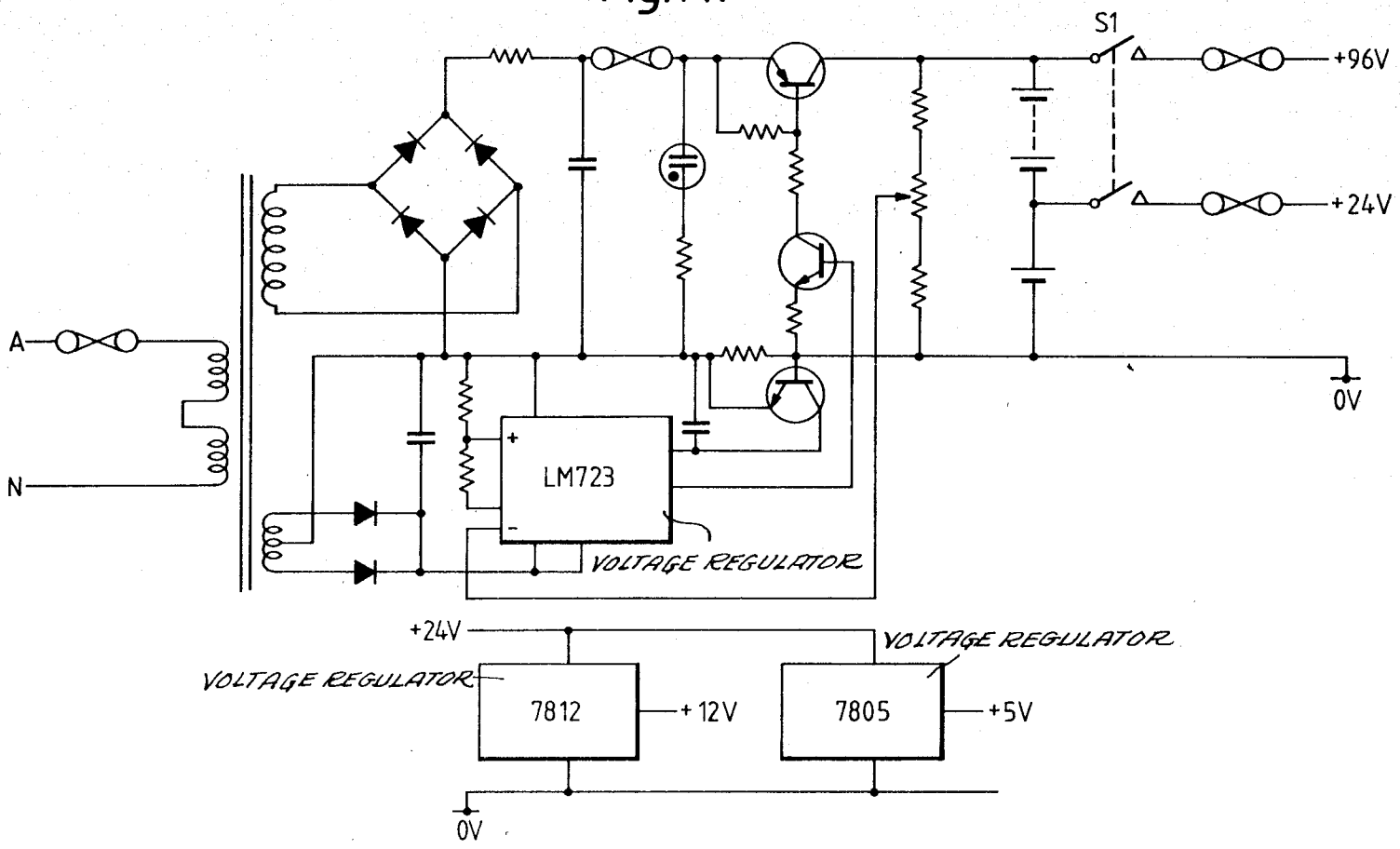
Figure 15:
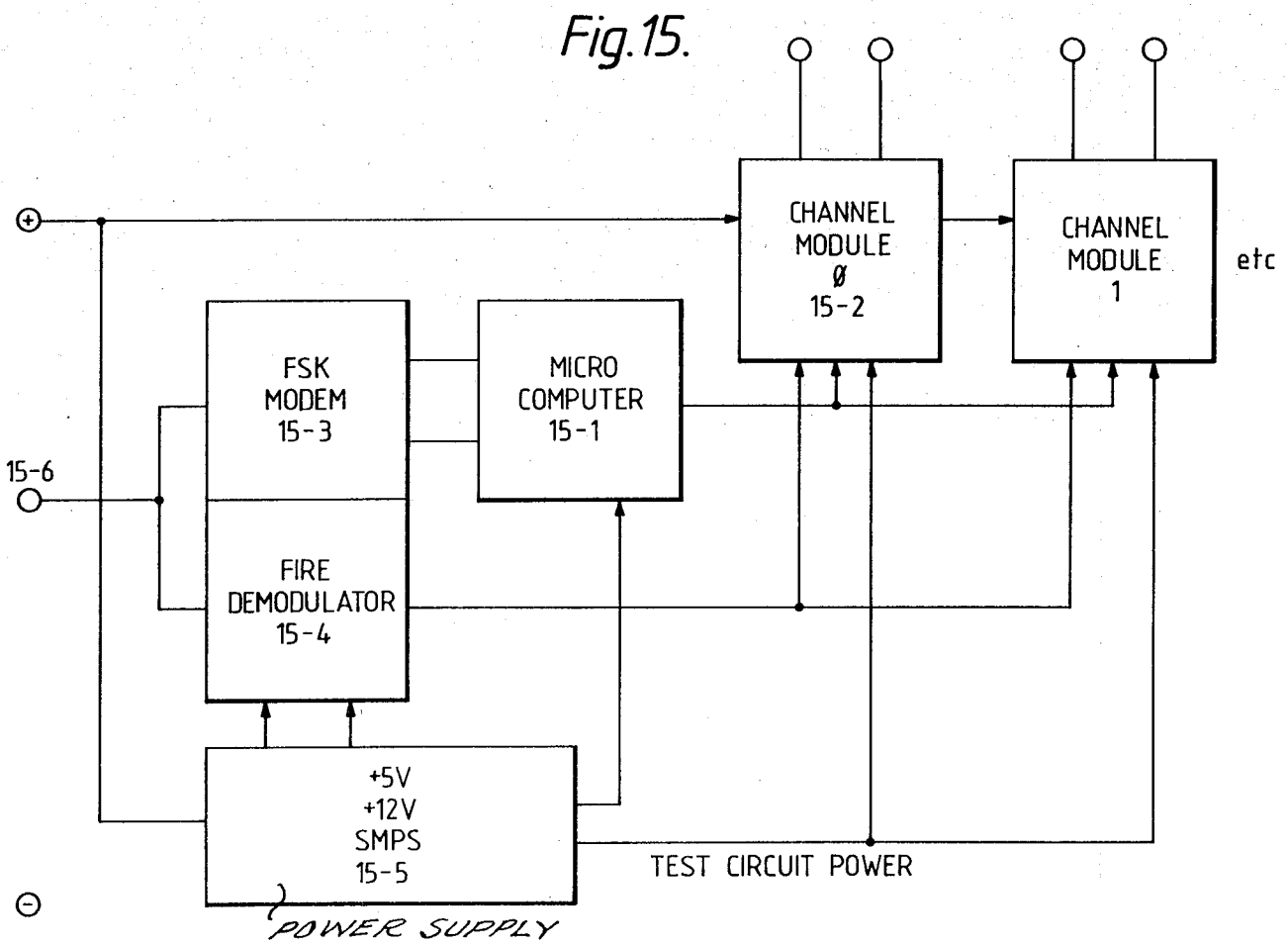
Figure 16:
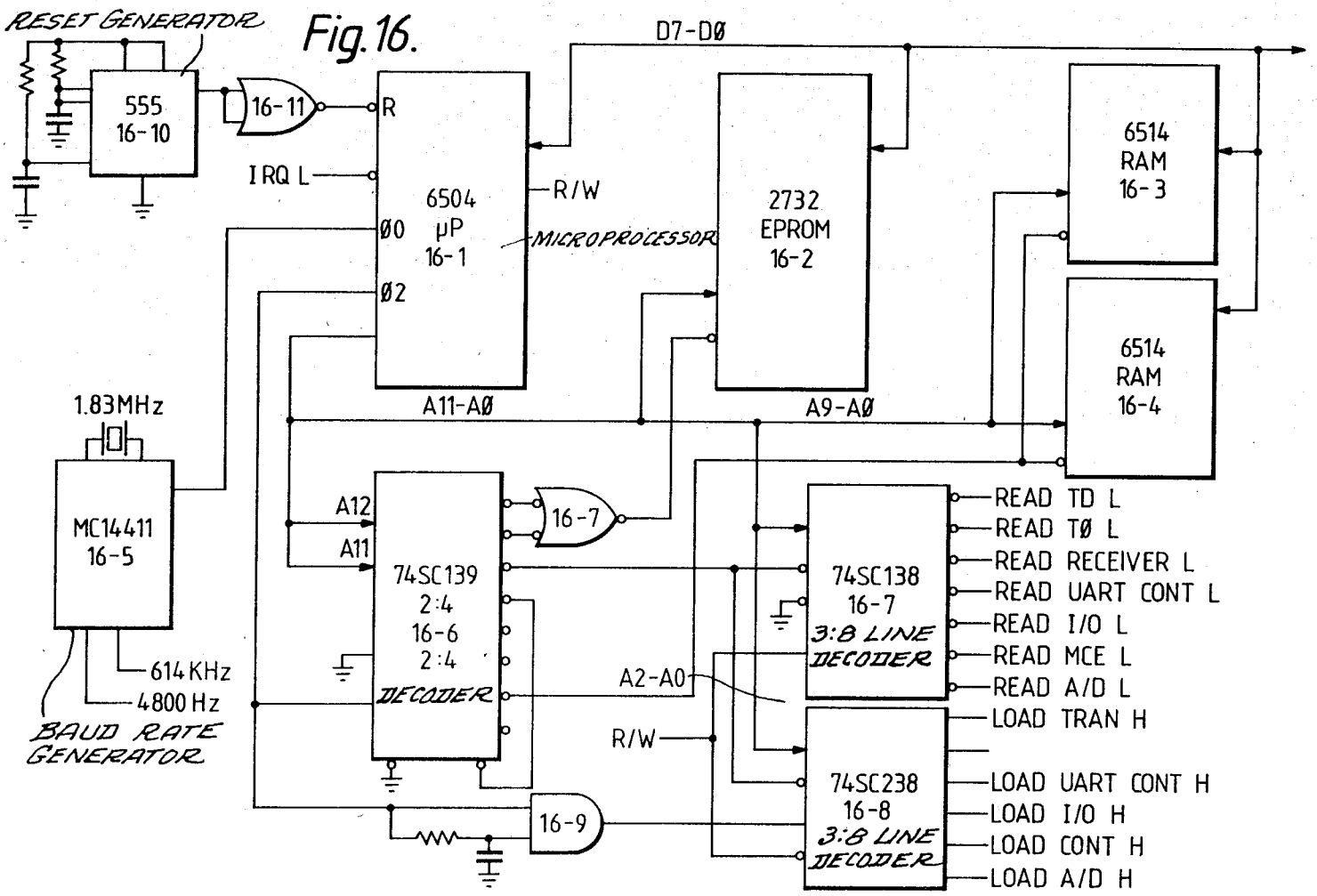
Figure 17:
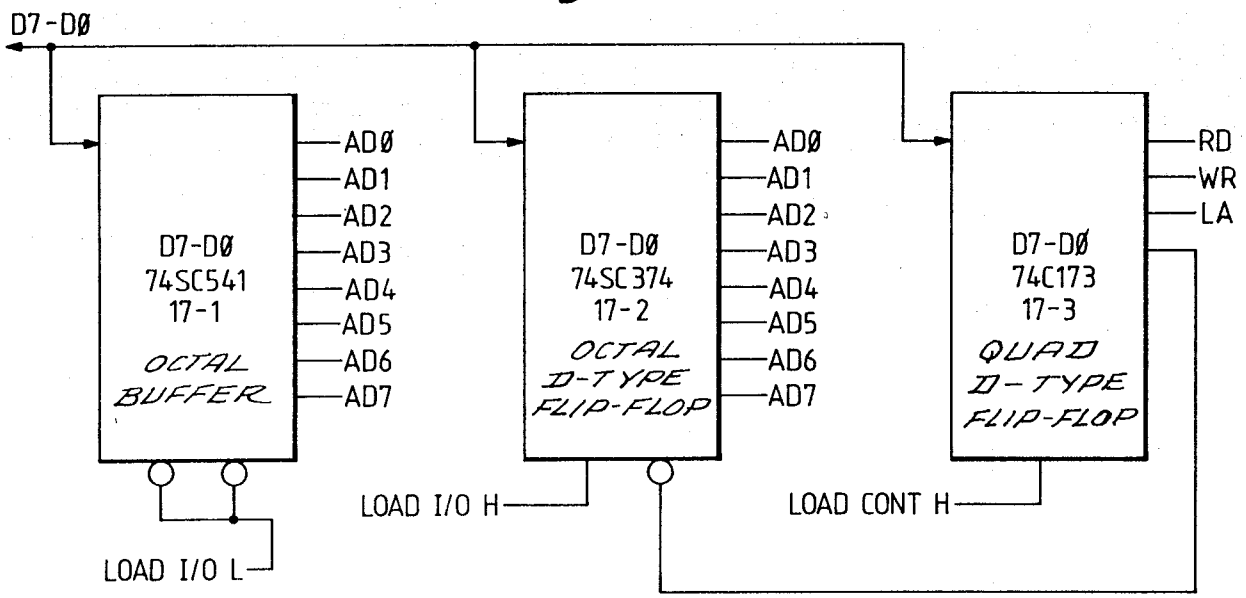
Figure 18:
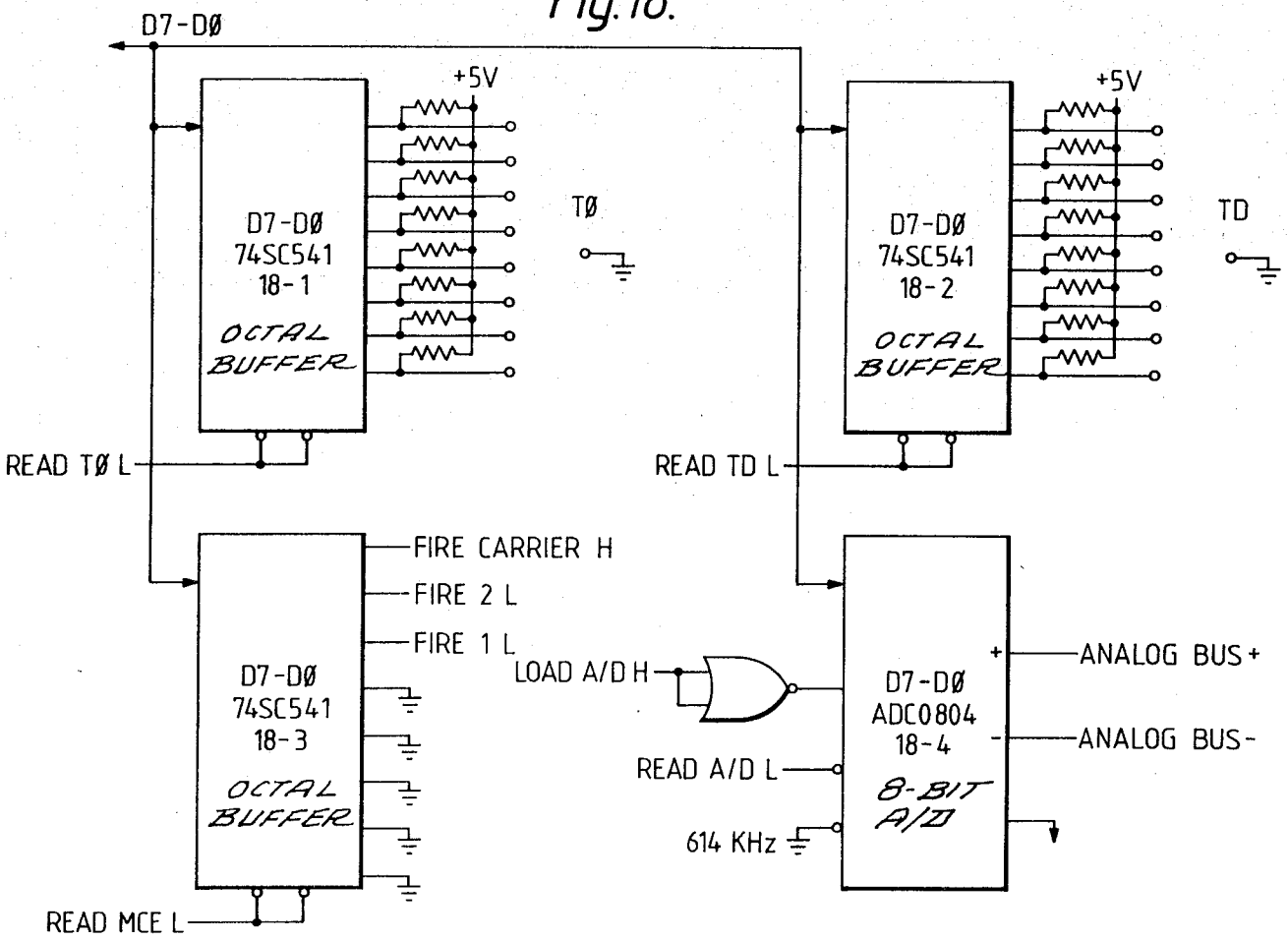
Figure 23:
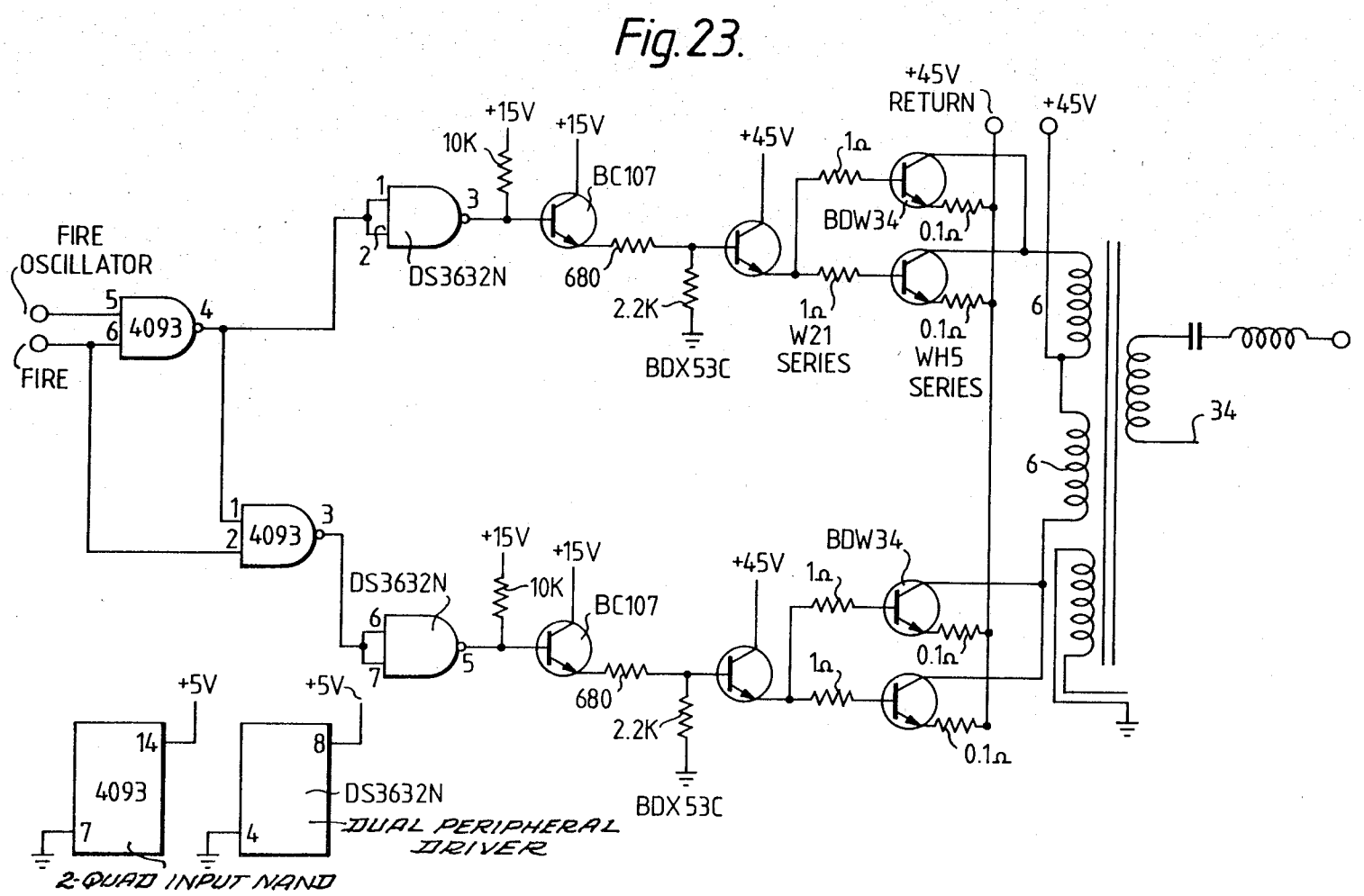
Figure 24:
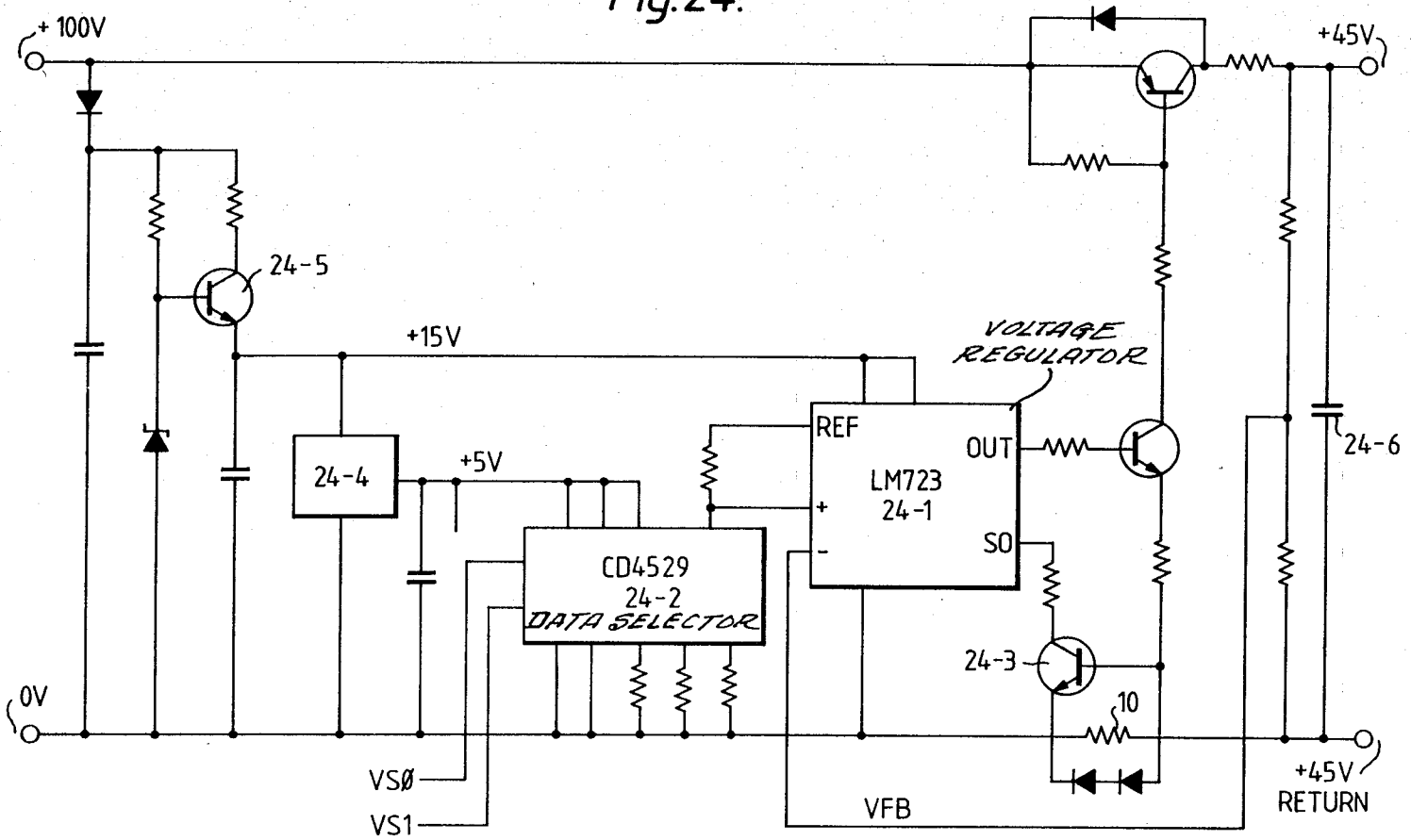

The invention is illustrated by reference to a specific embodiment shown in the accompanying drawings, in which:

FIG. 1 is a schematic overall representation of the exploder system, showing a control unit and two of a number of MCEs connected to it, FIG. 2 shows a Magnadet firing circuit, FIG. 3 is an equivalent circuit of the Magnadet firing circuit, FIG. 4 is a block diagram of the Control Unit, FIGS. 5–8 provide details of the microcomputer used in the control unit, FIGS. 9–11 show the data Modem, transmit filters and receive filters respectively, used in both the Control Unit and the MCEs, FIG. 12 shows the Control Unit fire signal transmitter, FIG. 13 shows the MCE fire signal receiver, FIG. 14 shows the Control Unit power supply and battery charger FIG. 15 is a block diagram of a MCE, FIG. 16 shows the MCE processor address decoder, FIG. 17 shows the MCE channel module bus control FIG. 18 shows the MCE number and delay settings, FIGS. 19–22 show the MCE channel module address decoder, data selector, frequency generator and firing delay counter respectively, FIG. 23 shows the DC to AC inverter for providing the firing power output, and FIG. 24 shows the MCE channel module voltage regulator.

Figure 25:
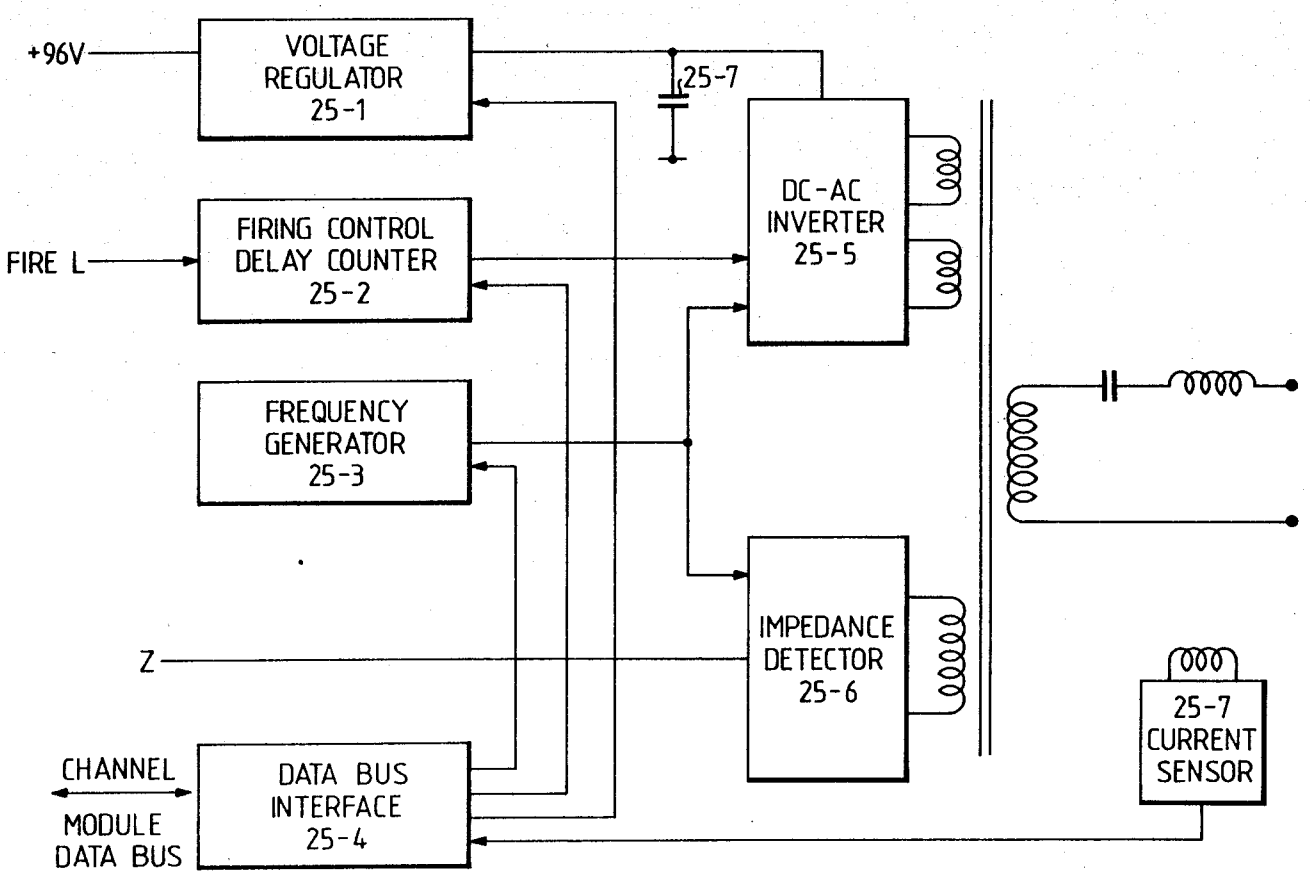

FIG. 25 is a block diagram of a channel module.

FIG. 1 shows schematically the exploder system. This consists of a control unit and a number of multichannel exploders of which two are designated as MCE 1 and MCE 2. Each of the two multi-channel exploders are equipped with ten output channels each of which is connected to a Magnadet firing circuit. Power to operate the multichannel exploders is supplied to them from the control unit via two cores of the connecting cable. Control signals between the control unit and the multichannel exploders is carried by the third core.

FIG. 2 shows a Magnadet firing circuit in more detail. The output channel 2-1 is connected to the Magnadet primary circuit by a length of firing cable 2-2. On the primary circuit 2-3 are shown three Magnadet detonators 2-4. The Magnadet detonator consists of a ferrite ring 2-5 with a few turns of wire wound around it and then connected to a standard electric detonator 2-6.

The primary circuit is passed once through the ferrite ring thus forming a current transformer.

Referring now to FIG. 3, an equivalent circuit diagram of the Magnadet firing circuit is shown again connected to an MCE output. The firing cable and primary wire circuit are represented by a resistance 3-2 and an inductance 3-3 whereas the Magnadets, as referred back to the primary circuit, are represented by a resistance 3-4 and an inductance 3-5. The inductance 3-3 typically has a value of 60–600 μH and the resistance 3-2 has a value of 5–10 ohm. Similarly, the resistance 3-4 has a value of $N \times 0.125$ ohm where N is the number of detonators and the inductance 3-5 has a value of $N \times 2.5$ μH. The ferrite rings are frequency selective and have an optimal energy transfer characteristic in the frequency range of 15–25 kHz. It will thus be appreciated that the inductive characteristic of the Magnadet firing circuit is significant.

In order to eliminate the inductive effect the output channel incorporates a series capacitor 3-6 which is of a suitable value so that the series resonant circuit formed has a resonant frequency between 15 and 25 KHZ.

Referring now to FIG. 4, shown therein is a block diagram of the Control Unit. This unit is built around a micro computer which is used to receive commands and display data for the operator. The computer translates these commands into the control messages for the multichannel exploders which it then transmits to the MCE's via the Frequency Shift Keyed (FSK) data modem. Acknowledgement of the command message together with status information is received back from the MCE via the FSK modem. The command to commence firing is transmitted to the MCEs from the Control Unit via the Fire signal modulator. Power for the Control Unit and the MCE's is provided by a rechargeable battery pack.

Figure 5:
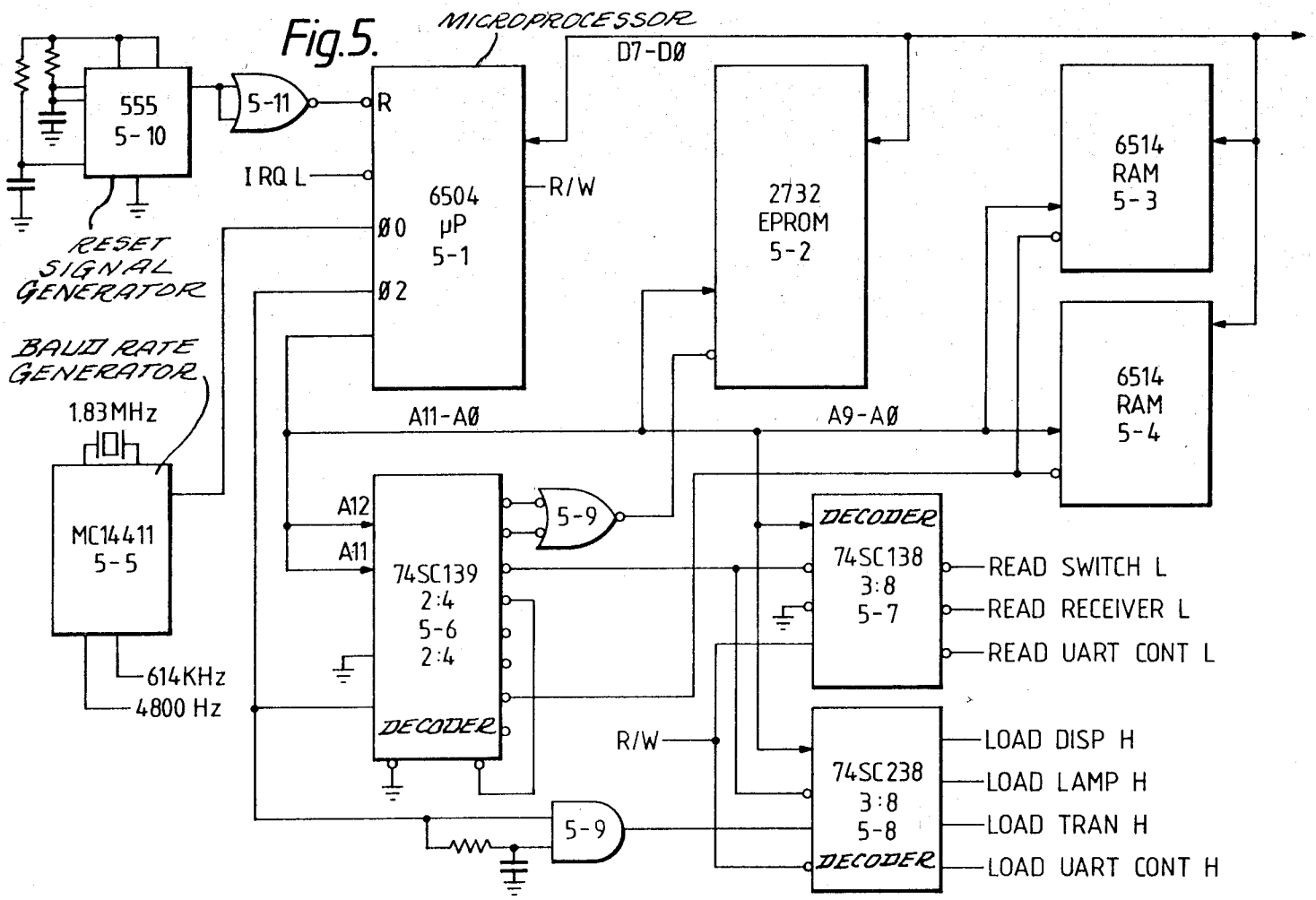

FIGS. 5–8 give details of the control units microcomputer. In FIG. 5, the 8K address space of the 6504 microprocessor 5-1 is divided into four by the 2 line to 4 line decoder 5-6. Two outputs are used to select the 4K PROM at 5-2. The third selects the I/O registers and the last selects the two RAM devices 5-3, 5-4.

I/O register selection is done by the two 3 to 8 line decoders at 5-7 and 5-8. 5-8 Selects the register for a write operation whilst 5-7 selects the register for a read operation.

Figure 6:
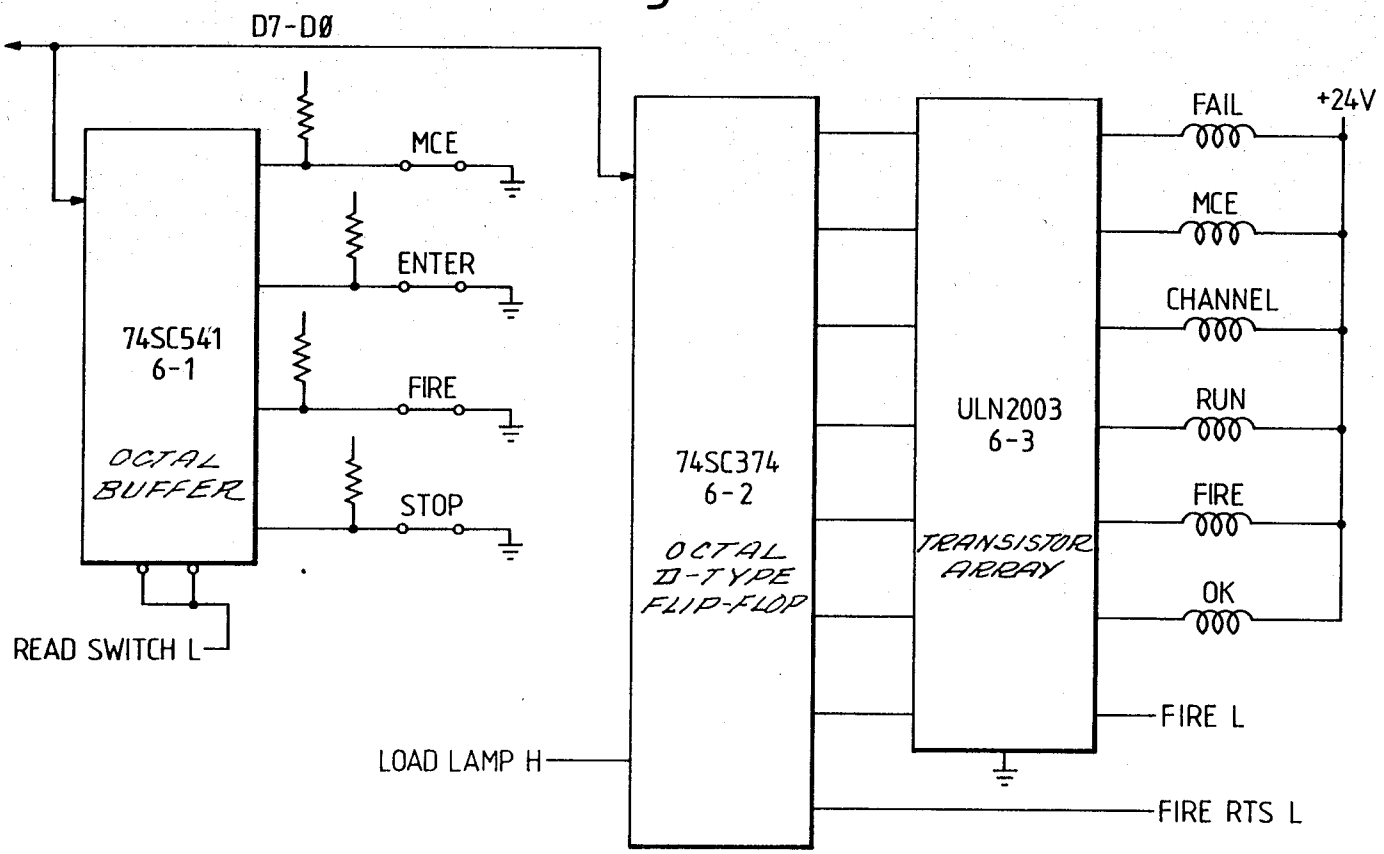

FIG. 6 shows the switch sensing and display. The status of the four switches is transferred onto the data bus by READ SWITCH L which is generated when the switch status register is addressed.

The six lamps are controlled from the lamp register 6-2. Data on the bus is loaded into the register by LOAD LAMP H. The outputs from the register control the darlington transistor array 6-3 which provide the switch to ground to drive the lamps.

The numeric display shown in FIG. 7 as 7-3 and 7-6 is controlled from the Display register, BCD data to be displayed is loaded into the latched 7 segment decoders 7-1 and 7-4 by LOAD DISP H. The two transistor arrays 7-2 and 7-5 provide the current boost necessary to drive the large LED displays.

Serial I/O is done in FIG. 8 by an industry standard CMOS UART 8-3. Serial data to be sent is loaded into the UART from the data bus by LOAD TRANS H which is generated when the transmitter register is addressed. When the transmitter register is empty TBRE is asserted which if transmitter interrupts are enabled will generate an interrupt request via IRQ.

Data received will generate a data ready (DR) signal which will generate an interrupt request via IRQ. Data is read from the receiver into the processor by READ RECEIVER L which is generated when the receiver register is addressed.

The baud rate generator 5-5 provides the transmitter and receiver clocks as well as the microprocessor clock.

Receiver error flags and other status information is read into the processor by READ UART CONT L which is generated when the UART control register 8-1, 8-2, 8-4 is addressed for a read operation. Control of transmitter idle interrupts is done by setting 8-1 in the control register.

Control of the modem transmitter is done by setting or resetting the RTS ff, 8-4.

The data modem used in both the Control Unit and the MCEs is shown in FIG. 9, and is based on a universal low speed modem MC14412. This device uses digital techniques to perform the FSK modulation - demodulation. Data to be transmitted is presented in serial format to the modulator which digitally synthesises a sine wave from the 1MHz oscillator reference.

The synthesised sine wave has a high harmonic content and this is removed by the 4 pole band pass filter amplifier, 9-2.

Operation of the transmitter section is controlled by RTS. When high this signal enables both the transmitter section of 9-1 and the output stage of 9-2. When low the transmitter section of 9-1 is disabled and the output stage of 9-2 is floated.

Data received on the line is filtered by the receive filter 9-3 and converted into a square wave by the LM 311 comparator at 9-4. This square wave is presented to the modem chip where it is demodulated to produce the serial data signal. The amplitude of the received carrier is measured by the second LM 311 comparator 9-5. If the amplitude of the received carrier falls below the threshold the serial output is held high.

FIG. 10 gives details of the transmit filters used in both the control unit and the MCEs.

FIG. 11 gives details of the receive filters used in both the control unit and the MCE's.

The fire signal transmitter of the control unit is shown in FIG. 12.

The firing signal is produced by the XR 2206. Function Generator 12-1.

The frequency of oscillation of this IC is determined by the logic level present on pin 9. When pin 9 is taken low by the firing switch the frequency shifts from the stand-by frequency to the firing frequency.

The sine wave generated at pin 2 is amplified by 12-2. The output stage of the amplifier is turned on and off by FIRE RTS which enables the output when it is high.

The firing signal decoder used in each MCE is shown in FIG. 13.

The firing signal transmitted by the control unit is separated from the data by the bandpass filter 13-3 and decoded by the XR2211 FSK demodulator. 13-2. This device is a phase-locked loop which tracks the input signal within the pass band and a voltage comparator which provides FSK demodulation. A separate quadrature phase detector provides carrier detection. The output from the comparator is "anded" with the carrier detected signal to produce the FIRE L signal.

The control unit power supply, battery pack and battery charger are shown in FIG. 14. Power for the control unit and the multichannel exploders is provided by twelve sealed lead-acid batteries. These batteries are built into the control unit and can be recharged from the mains by the built in charger. The low voltage supplies for the control unit are provided from a tap at 24 v to two 3-terminal regulators which provide +12 and +5 volts.

The format of each MCE is shown as a block diagram in FIG. 15. The design of the exploder is based around the microprocessor board, which sets up the channel modules ready for firing and also handles data communication between the exploder and the control unit. Data to be transmitted or received is frequency coded/decoded by the data modem.

Communication between the processor and the channel modules is over an 8 bit bidirectional data bus. Each channel module is allocated an address on the bus with subaddressing defining the control registers within each channel module.

Each of the channel modules shown in block diagram form on FIG. 25 is a self-contained single channel exploder which can be programed by the CPU for output firing frequency, output power and channel delay. Each channel incorporates an impedance measuring circuit which can be used by the output power.

The processor itself is not capable of firing the channel modules. It is however capable of enabling and disabling the fire control unit within each channel module and reporting the status of these back to the master control unit. Firing of the channel modules is done in parallel by the fire signal demodulator. Once triggered each module will run independent of the processor and the other output modules, firing when their delay counter reaches zero.

The actual firing signal is frequency shift keyed using a separate frequency to the two used by the data modem. The firing signal is established at the stand-by frequency. Then the slave exploders are polled to check that they are receiving this frequency. After successful polling the firing takes place by changing the frequency to the firing one.

Power for modem, fire demodulator, CPU and the impedance measuring circuits within each channel module is provided by the switched mode power supply 15-5 (SMPS). Power for the firing circuits within each channel module is provided from separate voltage regulators within each channel module.

The SMPS provides power conversion so that the current drain at 150 v is considerably reduced.

The MCE processor board shown in FIG. 16 contains the 6504 microprocessor, memory, serial line interface and channel module bus interface. The 8k address space of the 6504 microprocessor 16-1 is divided into four by the 2 line to 4 line decoder 16-6. The two most significant outputs are used to select the 4k PROM at 16-2. The next output selects the I/O registers, whilst the last selects the two RAM devices 16-3, 16-4.

I/O register selection is done by the two 3 to 8 line decoders at 16-7 and 16-8, 16-8 selects the register for a write operation whilst 16-7 selects the register for a read operation.

The means for controlling the various modules by the MCE processor, is shown in FIG. 17, and this operates as follows. Communication between the processor and the channel modules is via an 8 bit address/data bus. The address or data to be written onto the bus is latched into 17-2 by LOAD I/O H which is generated when the channel I/O register is addressed for a write operation. Data is read from the bus via 17-1 when READ I/O L is asserted by the address decoder during a read cycle.

Control of the channel module bus is done by loading the channel module control register 17-3. Bit Ø of this register controls the tristate output of 17-2. Bit 1 drives the RD control line, Bit 2 drives the WR control line and Bit 3 drives the LA control line.

The control bit sequence for a complete output cycle of address then data is

| | LA | WR | RD | Tri-State |
|---|---|---|---|---|
| idle | Ø | Ø | Ø | Ø |
| address out | Ø | Ø | Ø | Ø |
| Load address | 1 | Ø | Ø | Ø |
| data out | Ø | Ø | Ø | Ø |
| Load data | Ø | 1 | Ø | Ø |

The control bit sequence for a read cycle is

| | LA | WR | RD | Tri-State |
|---|---|---|---|---|
| idle | Ø | Ø | Ø | Ø |
| address out | Ø | Ø | Ø | Ø |
| load address | 1 | Ø | Ø | Ø |
| transmitter off | Ø | Ø | Ø | 1 |
| read data to bus | Ø | Ø | 1 | 1 |
| read data off bus | Ø | Ø | Ø | 1 |
| idle | Ø | Ø | Ø | Ø |

In these two sequences the bus is left with the processor transmitting. During the read sequence the bus is carefully turned around by turning the processor end off before the channel module end is turned on so as to avoid a transient state of both transmitters on.

Referring now to FIG. 18, the MCE number is read via a read operation to the CONT/MCE register 18-3 The MCE number is set by wiring bits Ø-5 to the binary number of the MCE. Bits 6 and 7 of this register give the status of the two fire signals FIRE 1 and FIRE 2.

The initial delay is read via a read operation to the TØ register 18-1. The initial delay is set by switching one of bits Ø-7 high and the other bits low. The delay value corresponding to this bit position is selected from a table in the program.

The delay between channels is read via a read operation to the TD register 18-2. The between channel delay is set by switching one of bits Ø-7 high and the other bits low. The delay value corresponding to this bit position is selected from a table in the program.

The voltage present on the analog data bus is converted to binary by the 8 bit A/D 18-4. Conversion is initiated by LOAD A/D H which is generated by a write operation to the A/D control register. Data from the A/D is strobed onto the data bus by READ A/D L which is generated during a read operation to the A/D control register.

Figure 19:
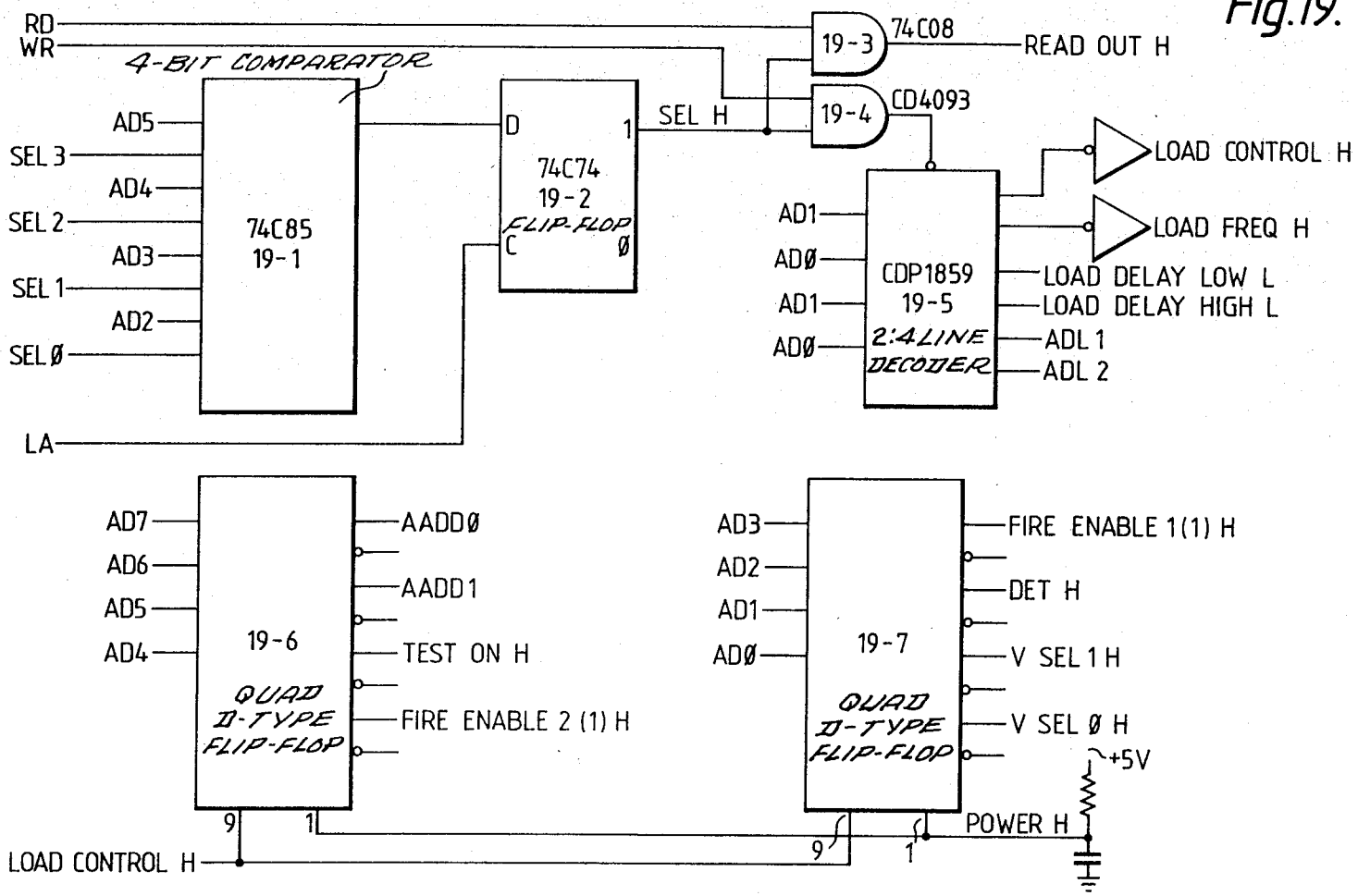

Channel module address/data bus transfer is effected by the circuits shown in FIG. 19. Channel module and register selection is done by the processor putting the address out onto the address/data bus. Bits 5, 4, 3 and 2 select the channel module and bits 1 and Ø select the register within the module. When the channel module address matches the channel number set by Sel Ø - Sel 3 the output of the magnitude comparator 19-1 is high.

After the address has settled the load address signal LA is asserted by the processor and this latches bits 519 and 1 into the 2 to 4 line decoder 19-5 and sets the SEL flip flop 19-2.

For data transfers out of the processor the processor then puts out the data on the address/data bus and after it has settled asserts WD which after anding with SEL H enables the 2 to 4 line decoder 19-5 which then generates the appropriate load signal.

Figure 20:
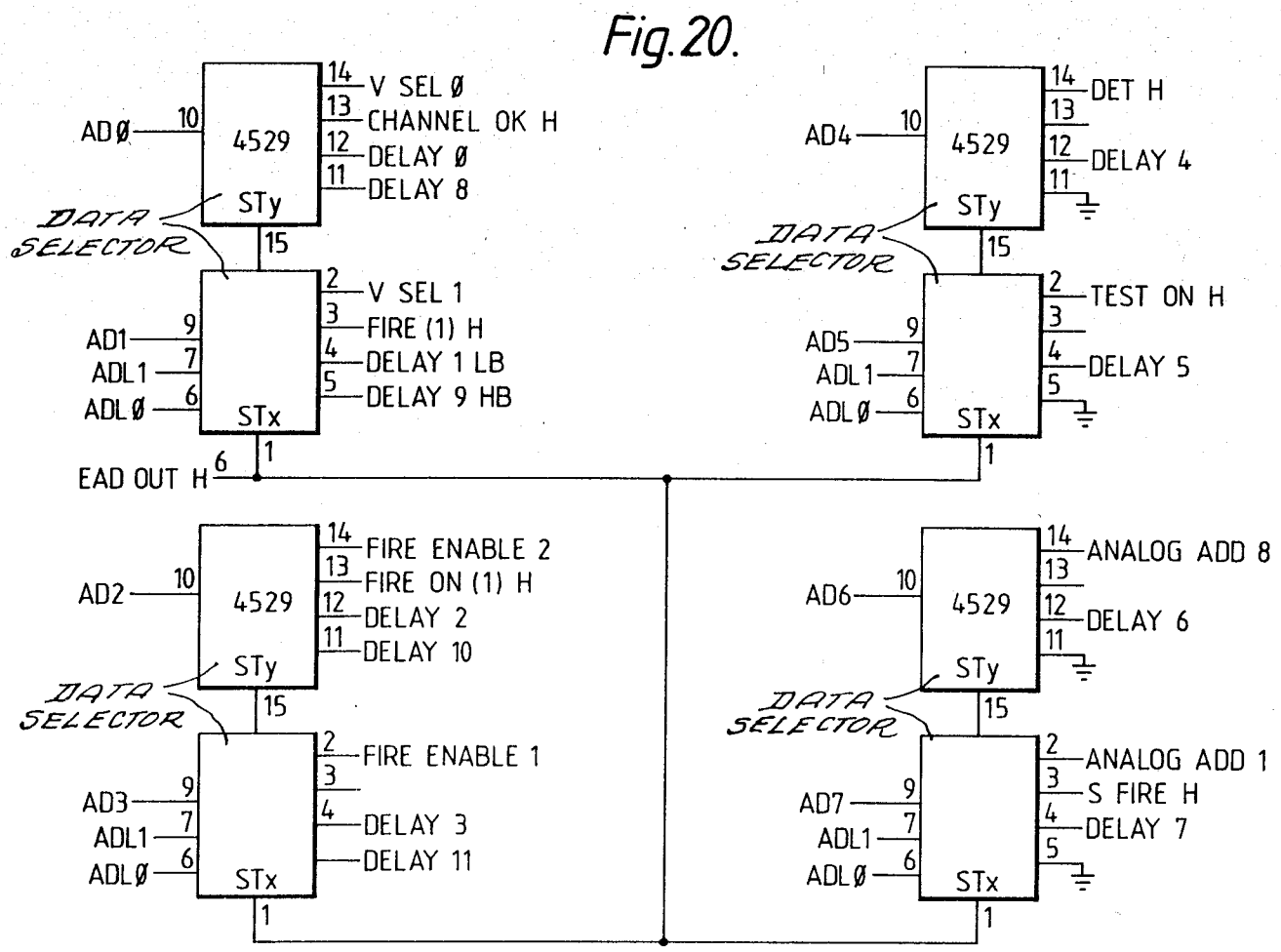

For data transfers into the processor the processor asserts RD which, following anding with SEL H, gates the input to the data selector onto the data bus, as shown in FIG. 20. Register selection is done by the latched address bits ADLØ and ADL 1. .

Figure 21:
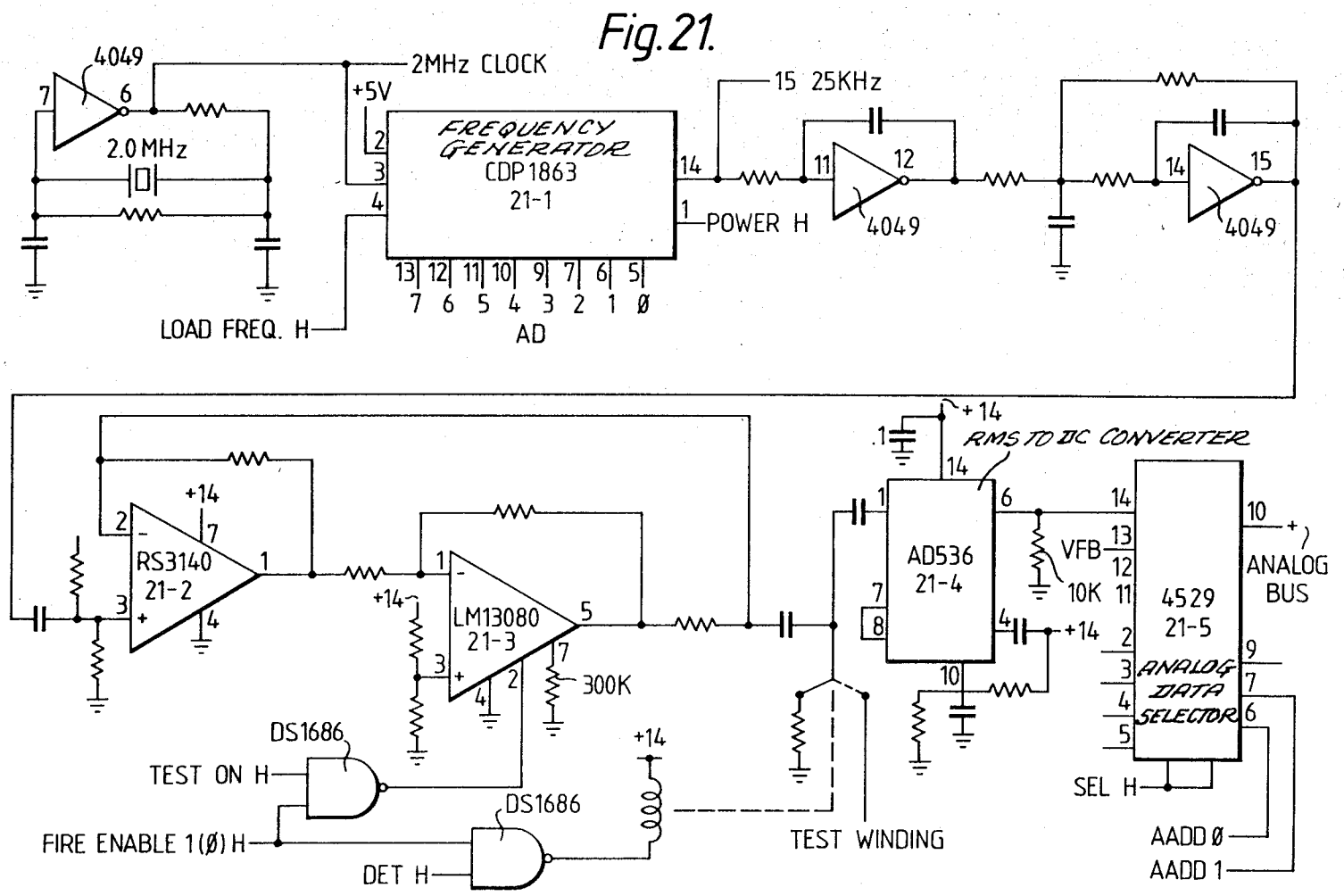
Figure 22:
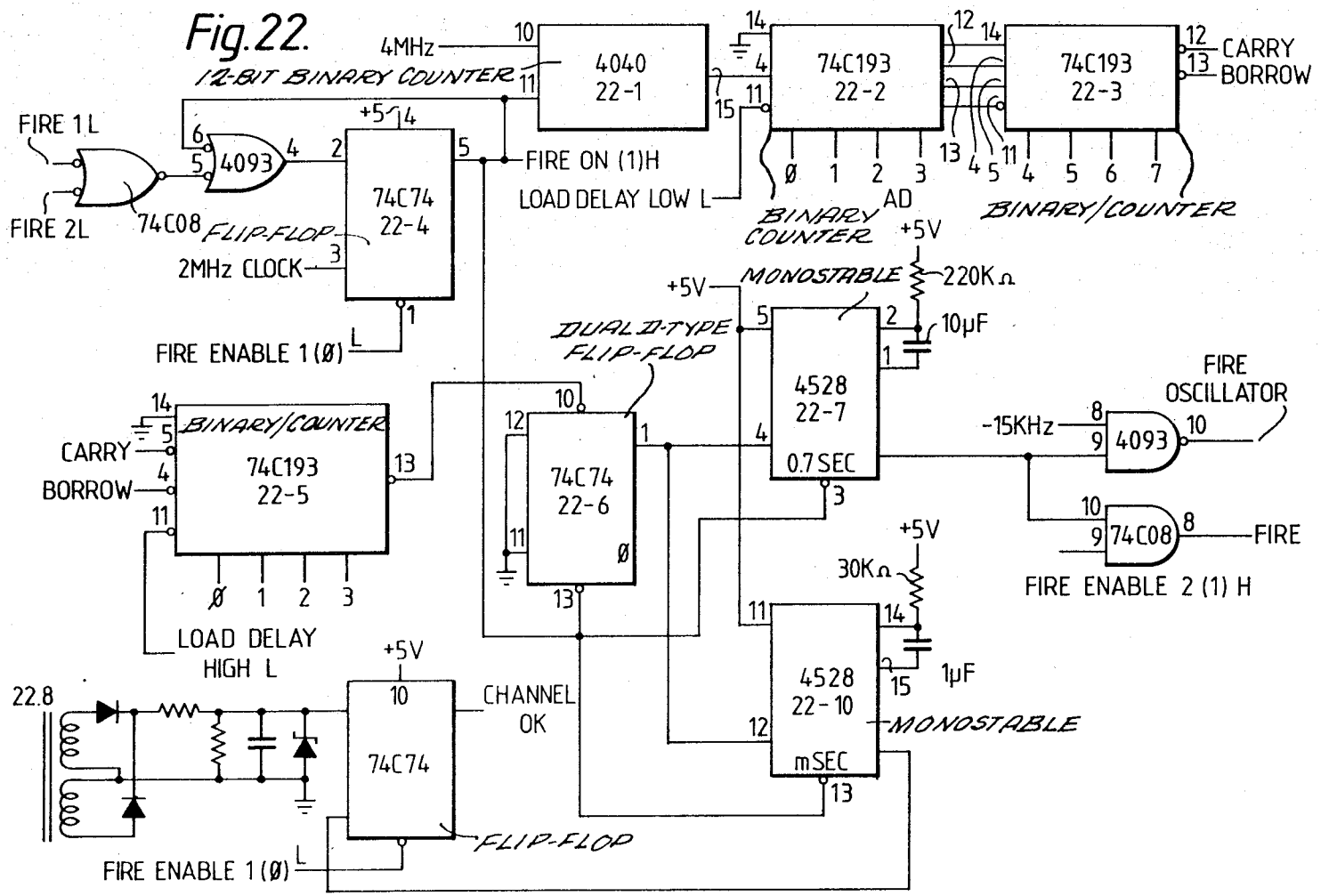

The control board of each MCE channel module carries its own frequency generator, as shown in FIG. 21.

This board contains a 2.00 MHz crystal oscillator which supplies both the delay generator and the programmable frequency generator 21-1 which generates a square wave of 15–25 KHz in approx 2 KHz steps. The output from this generator drives the DC inverter and a test signal generator.

This test signal generator consists of a constant current generator 21-2, 21-3 which drives a 50 mA square wave into the test current winding of the output transformer. The voltage generated across the primary winding is converted to DC by 21-4 and switched via the analog data selector 21-5 into the analog data bus where it is converted to binary by the processors A/D.

The exact value of the current source is found by switching it to the reference resistor. During firing the output is also switched to the reference resistor as the test current winding will have 120 v across it at this stage.

As this circuit consumes a significant current, power to it is controlled by TEST ON L.

The processor uses this circuit to plot the impedance Vs frequency of the detonator firing circuit, the impedance falling to a sharp minimum at the resonant frequency. The processor then selects the firing frequency which gives minimum impedance and based on the value of this minimum selects the capacitor voltage required.

The firing delay required by the channel module is programmed into the down counter formed by 22-2, 22-3, 22-5 during the initialisation of the slave. The 1 ms clock for driving the down counter is provided by the prescaler 22-1. Phase synchronisation between channel modules is achieved by holding this prescaler reset until the firing signal sets the FIRE ON ff. When the down counter reaches zero it sets the FIRE ff 22-6 and then the monostable 22-7 which then gates the 15–25 KHz signal onto the DC inverter input.

Arming of the firing circuit is done via the two signals FIRE ENABLE 1 and FIRE ENABLE 2. These two signals are generated by loading the control register bits 2 and 3 with a logic 1.

Once armed the firing circuit then waits until either of FIRE 1 or FIRE 2 go low causing the FIRE ON ff 22-4 to be set and the sequence started.

The detonator firing current passing out of the channel is monitored by a small current transformer 22-8 whose output is rectified and filtered. If the firing current is of a satisfactory value the DC level at the output of the filter will be sufficient to set the channel OK ff 22-9 10 ms after firing.

The status of this ff is then sent to the control unit after all MCEs have fired. Any failing channels will be displayed on the control unit displays.

FIG. 23 gives details of the DC to AC inverter which generates the detonator firing current. This consists of two pairs of power transistors arranged in a push pull configuration.

When the FIRE signal is low base drive to both of the pairs is turned off. When the FIRE signal is high both of the 4093 gates are enabled and the 15–25 KHz oscillator output is fed to the base driver circuits, the second gate providing the necessary phase inversion.

The circuit for charging the capacitor bank is given in FIG. 24. This consists of a LM 723 voltage regulator 24-1 and an analog data selector 24-2 which switches the voltage reference for the regulator. Voltages of 0, 22, 33, 45 volts can be selected by loading bits Ø and 1 of the channel module control register with ØØ, Ø1, 1Ø, 11 respectively. During charging of the capacitor bank the charging current is limited to 50 mA by shutting down the LM 723 regulator using the transistor 24-3.

Low voltage supplies for the channel module are regulated by transistor 24-5 and a three terminal regulator 24-4.

I claim:

1. An apparatus for initiating explosions by providing an electrical firing current in a plurality of detonator circuits connected thereto, said apparatus comprising:

a control unit locatable remote from the detonator circuits, at least one multi-channel exploder (MCE) connected to said control unit and having a plurality of channels, each channel being provided with output means for connection to one of the detonator circuits, each MCE comprising energy storage means for receiving and storing electrical energy provided by the control unit, means for testing the impedance of the detonator circuit connected to each channel thereby to detect whether the circuit is complete or broken, and firing means responsive to a firing signal from the control unit for converting at least a portion of the energy storage means into a firing current in each channel at a predetermined time interval after receipt of the firing signal;

and the control unit comprising an energy source from which to provide the electrical energy requirements of all the MCEs connected thereto, means for interrogating each MCE to determine whether or not all of the MCE's channels have complete detonator circuits, and a firing signal generator to activate the firing means in the MCEs.

2. Apparatus as claimed in claim 1 wherein the control unit and each of the MCEs is provided with send and receive circuits including addressing means to enable each MCE to be interrogated by the control unit using a common communications link.

3. An apparatus as claimed in claim 1 or claim 2 wherein the control unit has a firing signal generator adapted to transmit at least one characteristic frequency, the interrogating means is adapted to determine whether or not all of the MCE's are detecting the presence of the said characteristic frequency and each MCE contains a means for detecting the presence of the said characteristic frequency and a means for communicating the presence of the said characteristic frequency to the control unit.

4. An apparatus as claimed in claim 1 or claim 2 wherein the said MCE comprises a processor and a plurality of channels connected to and controlled by said processor, said processor also providing an interface between the channels and the communications link to the control unit, the channels each having their own energy storage means, impedance testing means and firing means.

5. An apparatus as claimed in claim 3 wherein each channel has its own built-in impedance testing means.

6. An apparatus as claimed in claim 3 wherein each firing means has its own built-in time delay means.

7. An apparatus as claimed in any one of claims 1 or 2 wherein each impedance testing means is adapted to provide a quantitative measure of the impedance of the circuit tested, and each channel comprises means responsive to its measured impedance for regulating the voltage of the energy stored, or the proportion thereof converted to a firing current, to that voltage which produces a predetermined optimum current in its detonator circuit.

8. An apparatus as claimed in any one of claims 1 or 2 wherein the detonator circuits are transformer-coupled to detonators of the kind fired by alternating current.

9. An apparatus as claimed in claim 7 wherein the detonator circuits are coupled to electric detonators through ferrite rings.

10. An apparatus as claimed in claim 8 wherein the detonator circuit duly coupled to the detonators has a resonant frequency within the range 15–25 kHz, the resonant frequency of the circuit being substantially equal to the frequency of the a.c. current generated by the firing means.

11. An apparatus as claimed in claim 7 wherein the testing means comprises a variable frequency generator adapted to provide a test signal scanning a predetermined range of frequency, means to monitor changes in the detonator circuit impedance with changes in the test signal frequency and thereby to detect any frequency at which the impedance passes through a minimum, means to measure this minimum impedance and the frequency at which it occurs, this latter frequency being the resonant frequency, and means to indicate when the measured impedance fails to pass through a minimum within the range of frequencies applied;

and the firing means having programmable means for setting the frequency of the firing current to the resonant frequency of the detonator circuit as determined by the testing means.

12. An apparatus as claimed in claim 11 wherein the testing means and firing means utilise the same frequency generator.

13. An apparatus as claimed in claim 11 characterised in that the alternating test current is transformer coupled to the detonator circuit.

14. An apparatus as claimed in any one of claims 1 or 2 wherein each MCE channel is provided with means for detecting when it fails to supply a firing current in response to a firing signal and the control unit has means for indicating when any channel has so failed.

15. An apparatus as claimed in claim 14 wherein each MCE has means for identifying any failed channel and the control unit has means for displaying such identification.

16. A method for initiating explosions by providing an electrical firing current in a plurality of detonator circuits comprising connecting each detonator circuit to a channel of at least one multi-channel exploder (MCE), connecting said MCE to a control unit located remote from said detonator circuits, said MCE comprising energy storage means for receiving and storing electrical energy provided by said control unit, means for testing the impedance of the detonator circuit connected thereto to detect whether said circuit is complete or broken and firing means responsive to a firing signal from the control unit for converting at least a portion of the stored energy into a firing current in said channel at a predetermined time interval after receipt of a firing signal, and said control unit comprising an energy source to provide electrical energy to said MCE, means for interrogating said MCE to determine whether or not said channel is connected to a complete detonator circuit and a firing signal generator to activate said firing means in the MCE, providing electrical energy from said energy source to said energy storage means, testing the impedance of said detonator circuit, interrogating said MCE to determine whether or not said channel is connected to a complete detonator circuit and generating a firing signal to actuate said firing means to provide firing current in said detonator circuit.

17. A method as claimed in claim 16 wherein the detonator circuits are transformer coupled to electric detonators, the impedance of each detonator circuit is tested by applying an alternating test signal to the detonator circuit at a frequency which at least includes the resonant frequency of the detonator circuit and detecting the impedance at the resonant frequency, and a firing current is produced from the firing means substantially at the resonant frequency of the detonator circuit.

* * * * *